US006756190B2

(12) United States Patent
Sakai

(10) Patent No.: US 6,756,190 B2
(45) Date of Patent: Jun. 29, 2004

(54) SILVER HALIDE COLOR PHOTOGRAPHIC LIGHT-SENSITIVE MATERIAL

(75) Inventor: Hidekazu Sakai, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/603,760

(22) Filed: Jun. 26, 2003

(65) Prior Publication Data

US 2004/0005520 A1 Jan. 8, 2004

(30) Foreign Application Priority Data

Jun. 28, 2002 (JP) ..... 2002-190587

(51) Int. Cl.[7] ..... G03C 1/83; G03C 1/825; G03C 7/22

(52) U.S. Cl. ..... 430/507; 430/508; 430/606

(58) Field of Search ..... 430/507, 508, 430/606

(56) References Cited

U.S. PATENT DOCUMENTS 2,265,547 A * 12/1941 Schneider
4,078,933 A 3/1978 Sugiyama et al.
4,940,654 A * 7/1990 Diehl et al. ..... 430/522
4,988,611 A * 1/1991 Anderson et al. ..... 430/606
5,683,860 A * 11/1997 Diehl et al. ..... 430/507
2002/0064733 A1 * 5/2002 Nash ..... 430/507

FOREIGN PATENT DOCUMENTS

JP 2002-169254 A 6/2002

* cited by examiner

*Primary Examiner*—Richard L. Schilling
(74) *Attorney, Agent, or Firm*—Birch, Stewart, Kolasch & Birch, LLP

(57) ABSTRACT

A silver halide color photographic light-sensitive material that has, on a transmissive support, at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloid layer, and that contains a water-soluble dye that gives a maximum absorption in the range of 570 to 610 nm and a half width at half maximum on the longer wavelength side of 40 nm or less in a hydrophilic colloid layer, and a water-soluble dye that gives a maximum absorption at 740 nm or more and a half width at half maximum on the shorter wavelength side of 100 nm or less in a hydrophilic colloid layer.

12 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material having improved workability and improved processing stability. Particularly, the present invention relates to a motion picture silver halide color photographic light-sensitive material.

BACKGROUND OF THE INVENTION

The motion picture, which is an application of silver halide photography, is a method of obtaining dynamic images by serially projecting densely-taken still pictures at a rate of 24 pictures per second, and it has a preponderantly high image quality as compared with other methods for reproducing dynamic images. However, recent rapid developments in electronic technologies and information processing technologies have come to propose a dynamic image reproduction means that gives an image quality close to that of a motion picture with a simpler process, such as a projector using a DMD device from Texas Instruments Incorporated or an ILA projector from Hughes-JVC. Therefore, also to the motion picture photographic material, it is desired to impart simplicity while maintaining its original high quality; in particular, simplification and reduction of time of operations in a processing laboratory, such as exposure and development, are demanded.

One of the factors that make handling of silver halide photographic light-sensitive materials difficult is that the materials before development processing must be handled in the dark. In the case of a silver halide photographic light-sensitive material for shooting that is required to have characteristics identical with those of human sight, it must be handled in the dark in principle. In contrast, in the case of a silver halide photographic light-sensitive material for prints that forms an image for appreciation based on information recorded in a silver halide photographic light-sensitive material for shooting, the material for prints does not always require to be handled in the dark. Many of silver halide photographic light-sensitive materials for prints actually put on the market have a decreased sensitivity in a specified wavelength range, thereby enabling operation under the light within the wavelength range (hereinafter referred to as "safelight"). For example, in the case of a motion picture silver halide photographic light-sensitive material (Fuji Color Positive Film F-CP (trade name), manufactured by Fuji Photo Film Co., Ltd., or the like), the sensitivity to light near a wavelength of 590 nm, which is between the sensitive wavelength of a green-sensitive emulsion layer and that of a red-sensitive emulsion layer, is lowered, therefore a light source that emits light near this specified wavelength (for example, low pressure sodium lamp) can be used as a safelight. However, a red-sensitive emulsion layer has sensitivity to the wavelength region though only slightly. Hence in the case where the brightness of the safelight is too high or where the material is exposed to the safelight for a long period of time, cyan fogging occurs due to exposure of the red-sensitive emulsion layer, giving an undesirable image. Therefore, from the viewpoint of operability, there has been demanded a material that hardly causes cyan fogging even when it is exposed to a brighter light source or to a safelight for a longer period of time, that is, a silver halide photographic light-sensitive material having a still lower sensitivity to light in the safelight wavelength range.

As a means for improving the operability in the dark (hereinafter referred to as "safelight safety (safelight immunity)"), it is conceived to introduce a colorant having absorption near the objective wavelength into a light-sensitive material. The colorant to be used for such a purpose is required to satisfy the following performances. That is, the following three points must be satisfied.

(1) The colorant has an appropriate spectral absorption according to purpose. That is, it has an absorption in the objective wavelength range but has no absorption in the wavelength regions that are normally required by a light-sensitive material (i.e. no reduction in sensitivity of the light-sensitive material).

(2) The colorant gives no adverse chemical influence to a silver halide emulsion layer in the light-sensitive material. For example, it gives no change in sensitivity, no fogging, and the like.

(3) In order not to leave harmful coloring on the photographic light-sensitive material, the colorant is fully decolorized or easily eluted from the photographic light-sensitive material during photographic processing procedures.

In particular, the issue of sensitivity of light-sensitive materials is important from the viewpoint of exposure operation in processing laboratories. Decreasing sensitivity of a light-sensitive material results in improvement in the safelight safety thereof. However, the decreased sensitivity means increase of the time necessary for exposure, with the result that the operability decreases. Therefore, a desired mode is to decrease only the sensitivity to safelight without decreasing the sensitivity to the wavelength regions that are normally required for light-sensitive materials.

An example of methods to introduce such colorant is a method that introduces a water-soluble dye into a light-sensitive emulsion layer or into a non-light-sensitive water-soluble colloid layer. Examples of the dye that can be used in such methods include oxonol dyes described in U.S. Pat. No. 4,078,933, and in addition, azo dyes, anthraquinone dyes, allylidene dyes, styryl dyes, triarylmethane dyes, merocyanine dyes, cyanine dyes, and the like.

As another introduction method, a method is known in which fine grains of colloidal silver are added in non-light-sensitive hydrophilic colloid layer(s) existing above and/or below a red-sensitive emulsion layer. On the other hand, JP-A-2002-169254 ("JP-A" means unexamined published Japanese patent application) proposes a method of adding a solid fine-particle dispersion of a dye that can be removed at the time of development processing to non-light-sensitive hydrophilic colloid layer(s) existing above and/or below a red-sensitive emulsion layer. In particular, a method using a solid fine-particle dispersion of a dye that can be removed at the time of processing, can control the hue of a colored layer, and can achieve a balance between reduction in sensitivity in the safelight wavelength region and maintenance of sensitivity in the wavelength region required for exposure. In addition, the method is an excellent method that is applicable to a motion picture positive film, which film uses silver generated by development processing to form a sound track.

On the other hand, among the studies conducted from the viewpoint of simplification of handling, a typical example of the studies performed from a viewpoint other than the above-mentioned safelight safety is a study on simplification and speeding up of development processing. As approaches to the speeding up of development processing from light-sensitive materials, there have been proposed various methods and major approaches can be summarized into the following two:

1) To increase developing speed, and
2) To speed up removal of unnecessary components.

Typical study examples of the former include development of a high silver chloride emulsion and use of highly activated couplers, and in the latter, typical study examples include improvement in bleaching/fixing speed and development of dyes that are easily decolorized.

However, in the case where a necessary amount of a water-soluble dye or a solid fine-particle dispersion of a dye is added for the above-mentioned safelight safety, a decrease in elution speed of the dye at the time of photographic processing is inevitable; and, it has been difficult to achieve improvement of safelight safety and reduction in coloring in white background compatibly. Therefore, development of a method for improving safelight safety that is highly efficient even with a smaller amount of a dye has been demanded.

SUMMARY OF THE INVENTION

The present invention is a silver halide color photographic light-sensitive material having, on a transmissive support, at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloid layer, and containing a water-soluble dye that gives a maximum absorption in the range of 570 to 610 nm and a half width at half maximum on the longer wavelength side of 40 nm or less in a hydrophilic colloid layer, and a water-soluble dye that gives a maximum absorption at 740 nm or more and a half width at half maximum on the shorter wavelength side of 100 nm or less in a hydrophilic colloid layer.

Other and further features and advantages of the invention will appear more fully from the following description.

DETAILED DESCRIPTION OF THE INVENTION

The inventor of the present invention has made extensive studies and as a result he has found that the above-mentioned problems can be solved by the means described below. In particular, in the improvement of safelight safety, although improvement by addition of a dye that has absorption in the same wavelength region as that of safelight is easily expectable, it is an unexpectable finding that further addition of a dye having absorption in a longer wavelength region in combination therewith results in increase in the safelight safety. The present invention has been accomplished based on this finding.

That is, the present invention provides:

<1> A silver halide color photographic light-sensitive material having, on a transmissive support, at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloid layer, and containing a water-soluble dye that gives a maximum absorption in the range of 570 to 610 nm and a half width at half maximum on the longer wavelength side of 40 nm or less in a hydrophilic colloid layer, and a water-soluble dye that gives a maximum absorption at 740 nm or more and a half width at half maximum on the shorter wavelength side of 100 nm or less in a hydrophilic colloid layer.

<2> The silver halide color photographic light-sensitive material according to <1> above, further containing a water-soluble dye that gives a maximum absorption in the range of from 650 to less than 740 nm and a half width at half maximum on the shorter wavelength side of 80 nm or less in a hydrophilic colloid layer.

<3> The silver halide color photographic light-sensitive material according to <1> or <2> above, in which a relationship between a transmission absorption density at 590 nm (AS) and a transmission absorption density at 800 nm (AI) is expressed by an expression as described below:

$$\frac{AI}{AS} > 0, \quad 3.$$

<4> The silver halide color photographic light-sensitive material according to any one of <1> to <3> above, wherein at least one cyan color-forming light-sensitive silver halide emulsion layer has a spectral sensitivity that has a maximum value in the range of 650 to 700 nm.

<5> The silver halide color photographic light-sensitive material according to any one of the above <1> to <4>, wherein at least one non-light-sensitive hydrophilic colloidal layer contains a solid fine-particle dispersion of a dye represented by the following formula (I):

$$D—(X)_y \qquad \text{Formula (I)}$$

wherein, in formula (I), D represents a group to give a compound having a chromophore, X represents a dissociable hydrogen or a group having a dissociable hydrogen, and y is an integer from 1 to 7.

<6> The silver halide color photographic light-sensitive material according to the above <5>, wherein the dye is a dye represented by the following formula (II) or (III):

$$A^1{=}L^1—(L^2{=}L^3)_m—Q \qquad \text{Formula (II)}$$

wherein, in formula (II), A represents an acidic nucleus, Q represents an aryl group or a heterocyclic group, $L^1$, $L^2$ and $L^3$ each independently represents a methine group, and m is 0, 1 or 2, and the compound represented by formula (II) possesses 1 to 7 carboxylic acid groups in its molecule;

$$A^1{=}L^1—(L^2{=}L^3)_n—A^2 \qquad \text{Formula (III)}$$

wherein, in formula (III), $A^1$ and $A^2$ each independently represents an acidic nucleus, $L^1$, $L^2$ and $L^3$ each independently represents a methine group, and n is 1 or 2, and the compound represented by formula (III) possesses, in its molecule, 1 to 7 carboxylic acid groups as the group having a dissociable hydrogen.

<7> The silver halide color photographic light-sensitive material according to the above <5>or <6>, wherein the solid fine-particle dispersion of a dye is prepared through a heat treating step carried out at 40° C. or higher.

Hereinafter, the silver halide color photographic light-sensitive material of the present invention will be described in more detail.

The present invention is a silver halide color photographic light-sensitive material having, on a transmissive support, at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloid layer, and containing a water-soluble dye that gives a maximum absorption in the range of 570 to 610 nm and a half width at half maximum on the longer wavelength side of 40 nm or less in a hydrophilic colloid layer and a water-soluble dye that gives a maximum absorption at 740 nm or more and a half width at half maximum on the shorter wavelength side of 100 nm or less in a hydrophilic colloid layer.

First, the dyes for use in the present invention will be described.

The dyes for use in the present invention may be dyes of any structures so far as they satisfy the above-mentioned requirements. Needless to say, they are completely decolorized or are easily eluted from the photographic light-sensitive material during a photographic processing step in order not to give chemically adverse influences to the silver halide emulsion layers in the light-sensitive material or in order to leave no harmful coloring on the photographic light-sensitive material. The dyes include organic compounds and inorganic compounds. From the above-mentioned viewpoints, it is preferred that the dyes are organic compounds.

In the dye that gives a maximum absorption at 740 nm or more, the position of the maximum absorption wavelength is preferably in the range of 740 to 1,200 nm, more preferably in the range of 740 to 1,100 nm. Examples of the compound include cyanine compounds, metal chelate compounds, aminium compounds, diimonium compounds, quinone compounds, squarilium compounds, and methine compounds. Such compounds are also described in "Shikizai (Color Materials)", 61[4], 215–226 (1988), and "Kagaku Kogyo (Chemical Industry)" 43–53 (May 1986). Preferred compounds include dihydroperimidine squarilium dyes (described in U.S. Pat. No. 5,380,635 and JP-A-10-36695), cyanine dyes (described in JP-A-62-123454, JP-A-3-138640, JP-A-3-211542, JP-A-3-226736, JP-A-5-313305, JP-A-6-43583, JP-A-9-96891, and European patent No. 0430244), pyrylium dyes (described in JP-A-3-138640 and JP-A-3-211542), diimonium dyes (described in JP-A-3-138640 and JP-A-3-211542), pyrazolopyridone dyes (described in JP-A-2-282244), indoaniline dyes (described in JP-A-5-323500 and JP-A-5-323501), polymethine dyes (described in JP-A-3-26765, JP-A-4-190343 and European patent No. 0377961), oxonol dyes (described in JP-A-3-9346), anthraquinone dyes (described in JP-A-4-13654), naphthalocyanine dyes (described in U.S. Pat. No. 5,009,989), naphtholactam dyes (described in European patent No. 568267), and metal chelate compounds. Among these, the cyanine dyes, polymethine dyes, oxonol dyes, anthraquinone dyes and metal chelate compounds are more preferred, with the cyanine dyes, oxonol dyes and anthraquinone dyes being particularly preferred.

Examples of the dye that gives a maximum absorption in the range of 570 to 610 nm include the oxonol dyes described in U.S. Pat. No. 4,078,933, and the like, as well as azo dyes, anthraquinone dyes, allylidene dyes, styryl dyes, triarylmethane dyes, merocyanine dyes, cyanine dyes, and the like that have a maximum absorption wavelength and a half width at half maximum in the ranges defined in the present invention. Among these, the azo dyes and oxonol dyes are preferred, the oxonol dyes, particularly pyridone-oxonol dyes and barbituric acid oxonol dyes, are more preferred, and the pyridoneoxonol dyes described in JP-A-2000-241936 are particularly preferred.

Examples of the dye that gives a maximum absorption in the range of from 650 to less than 740 nm include those dyes which are selected from compounds similar to those mentioned for the above-mentioned dyes having a maximum absorption in the range of 570 to 600 nm but which have a maximum absorption wavelength and a half width at half-maximum in the ranges defined in the present invention. Among them, azo dyes, oxonol dyes, anthraquinone dyes, and metal complex dyes are preferred, and anthraquinone dyes and oxonol dyes are more preferred.

The state of the dye in a hydrophilic colloid membrane (layer) includes a molecular dispersion state which shows a waveform that is little different from an absorption waveform measured in a state of a diluted solution; and an association state which shows an absorption waveform that differs from the result in a diluted solution. In embodiments of the present invention, the state of dye in a hydrophilic colloid membrane may be any state as long as the absorption waveform defined in the present invention is expressed in the layer. However, to make the dye be present in a molecular dispersion state is preferable in view of the effect of the present invention.

The absorption waveforms of the dyes in the present invention are measured by dissolving an objective dye in an aqueous solution of lime-processed gelatin, and preparing a coating membrane containing the dye in an amount of 30 $\mu$mol per 1 $m^2$, and measuring the membrane for absorption waveform with a spectrophotometer using an integrating sphere satisfying the geometric condition, condition f, prescribed in JIS Z 8722.

Assuming that a wavelength of a maximum absorption in the obtained absorption waveform is $\lambda_0$, a wavelength at a density corresponding to ½ the density at $\lambda_0$ on the shorter wavelength side is $\lambda_1$, and a wavelength at a density corresponding to ½ the density at $\lambda_0$ on the longer wavelength side is $\lambda_2$, $\lambda_0$-$\lambda_1$ is defined as a half width at half maximum on the shorter wavelength side and $\lambda_0$-$\lambda_2$ is defined as a half width at half maximum on the longer wavelength side.

The absorption waveform of the dyes for use in the present invention must have its half width at half maximum in either of the ranges defined in the present invention. More preferable is a waveform that has a small half width at half maximum and has an absorption in a narrow wavelength region. If a dye has a wide half width at half maximum and has a broad absorption waveform, a part of absorption of the dye falls in a sensitivity region that is required for exposure; and this results in a decrease in necessary sensitivity, thereby a light-sensitive material that is disadvantageous in exposure operations is obtained.

In the present invention, two or more dyes having an absorption in the same wavelength range can be used in combination. The dyes for use in the present invention can be added, by dissolving them in water, to a coating solution for a light-sensitive silver halide emulsion layer or a non-light-sensitive hydrophilic colloid layer.

In the present invention, the dyes may be added in any addition amount that is sufficient to exhibit the effects of the present invention. It is preferred that the dyes whatsoever their wavelength range is be added in such an amount that absorption density at a maximum wavelength in the light-sensitive material is in the range of 0.05 to 2.0, more preferably in the range of 0.1 to 1.5, and particularly preferably in the range of 0.2 to 1.0.

Furthermore, the ratio of the absorption density at 590 nm (hereinafter referred to as "AS") and the absorption density at 800 nm (hereinafter referred to as "AI") (AI/AS) may take any value. From the viewpoint of the effects of the present invention, the ratio is preferably in the range of 0.3 or more, more preferably in the range of 0.3 to 3.0, and most preferably 0.35 to 2.0.

It is preferable that the silver halide color photographic light-sensitive material of the present invention contains a solid fine-particle dispersion of a dye represented by formula (I) below.

$$D—(X)_y \qquad \text{Formula (I)}$$

In the formula (I), D represents a group to give a compound having a chromophore, X represents a dissociable hydrogen or a group having a dissociable hydrogen, and y denotes an integer of 1 to 7. The dye represented by the above formula (I) is characterized by the point that it has a dissociable hydrogen or the like in its molecular structure.

The group (D) to give a compound having a chromophore may be selected from many well-known dyes. Examples of the compound include oxonol dyes, merocyanine dyes, cyanine dyes, allylidene dyes, azomethine dyes, triphenylmethane dyes, azo dyes, anthraquinone dyes, and indoaniline dyes.

X represents a dissociable hydrogen or group having a dissociable hydrogen which is bonded to D directly or through a divalent linking group.

The divalent linking group disposed between X and D is a divalent group including an alkylene group, allylene group, heterocyclic residue, —CO—, —$SO_n$— (n=0, 1 or 2), —NR— (R represents a hydrogen atom, an alkyl group, or an aryl group) and —O—, and combinations of these linking groups. Further, these groups may have a substituent, such as an alkyl group, aryl group, alkoxy group, amino group, acylamino group, halogen atom, hydroxyl group, carboxy group, sulfamoyl group, carbamoyl group or sulfonamido group. Given as preferable examples of the divalent linking group are —$(CH_2)_n$— (n=1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociable hydrogen or group having a dissociable hydrogen represented by X is non-dissociable and has such characteristics that it makes the dye represented by the formula (I) substantially water-insoluble, in such a condition that the dye represented by the above formula (I) is added in the silver halide photographic light-sensitive material of the present invention. In a step of development processing of the light-sensitive material, the hydrogen or group represented by X has also such characteristics that it dissociates and makes the dye represented by the formula (I) substantially water-soluble. Given as examples of the group having a dissociable hydrogen represented by X are groups having a carboxylic acid group, sulfonamido group, sulfamoyl group, sulfonylcarbamoyl group, acylsulfamoyl group or phenolic hydroxyl group. Examples of the dissociable hydrogen represented by X include a hydrogen of an enol group of an oxonol dye.

A preferable range of y is from 1 to 5 and particularly preferably from 1 to 3.

Preferable examples among the compounds represented by the above formula (I) are those in which X, the group having a dissociable hydrogen, has a carboxylic acid group. Particularly, compounds having an aryl group substituted with a carboxyl group are preferred.

A more preferable one among the compounds represented by the above formula (I) is a compound represented by the following formula (II) or (III).

$$A^1{=}L^1{—}(L^2{=}L^3)_m{—}Q \qquad \text{Formula (II)}$$

In the formula (II), $A^1$ represents an acidic nucleus, Q represents an aryl group or a heterocyclic group, $L^1$, $L^2$ and $L^3$ each independently represents a methine group, and m denotes 0, 1 or 2. The compound represented by the formula (II) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen; and the groups are preferably selected from carboxylic acid groups.

$$A^1{=}L^1{—}(L^2{=}L^3)_n{—}A^2 \qquad \text{Formula (III)}$$

In the formula (III), $A^1$ and $A^2$ each independently represents an acidic nucleus, $L^1$, $L^2$ and $L^3$ each independently represents a methine group, and n denotes 0, 1, 2 or 3. The compound represented by the formula (III) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen; and the groups are preferable selected from carboxylic acid groups.

The compounds represented by formula (II) or (III) will be hereinafter explained in detail.

The acidic nuclei represented by $A^1$ and $A^2$ are preferably those derived from cyclic ketomethylene compounds or compounds having a methylene group sandwiched between electron attractive groups. Examples of the above cyclic ketomethylene compound may include 2-pyrazoline-5-one, rhodanine, hydantoin, thiohydantoin, 2,4-oxazolidinedione, isooxazolone, barbituric acid, thiobarbituric acid, indandione, dioxopyrazolopyridine, hydroxypyridone, pyrazolidinedione and 2,5-dihydrofuran. These compounds may have a substituent.

The compounds having a methylene group sandwiched by electron attractive groups may be represented by $Z^1CH_2Z^2$. Here, $Z^1$ and $Z^2$ each independently represents —CN, —$SO_2R^{11}$, —$COR^{11}$, —$COOR^{12}$, —$CONHR^{12}$, —$SO_2NHR^{12}$ or —$C[{=}C(CN)_2]R^{11}$. $R^{11}$ represents an alkyl group, an aryl group, or a heterocyclic group, and $R^{12}$ represents a hydrogen atom, or a group represented by $R^{11}$. These groups each may have a further substituent.

Examples of the aryl group represented by Q include a phenyl group and naphthyl group, which respectively may have a substituent. Examples of the heterocyclic group represented by Q may include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxodiazole, benzoquinoline, thiadiazole, pyrrolothiazole, pyrrolopyridazine, tetrazole, oxazole, coumarin and coumarone. These each may have a substituent.

The methine group represented by $L^1$, $L^2$ and $L^3$ may have a substituent and these substituents may be connected to each other to form a five- or six-membered ring (e.g., cyclopentene or cyclohexene).

No particular limitation is imposed on the substituent which each of the aforementioned groups may have, as far as the substituent does not allow the compound represented by any of the above formulae (I) to (III) to dissolve in water having a pH of 5 to 7. For example, the following substituents can be mentioned.

Specifically, examples of the substituent include a carboxylic acid group, a sulfonamido group having 1 to 10 carbon atoms (e.g., methanesulfonamido group, benzenesulfonamido group, butanesulfonamido group, and n-octanesulfonamido group), an unsubstituted, or alkyl- or aryl-substituted sulfamoyl group having 0 to 10 carbon atoms (e.g., unsubstituted sulfamoyl group, methylsulfamoyl group, phenylsulfamoyl group, naphthylsulfamoyl group, and butylsulfamoyl group), a sulfonylcarbamoyl group having 2 to 10 carbon atoms (e.g., methanesulfonylcarbamoyl group, propanesulfonylcarbamoyl group, and benzenesulfonylcarbamoyl group), an acylsulfamoyl group having 1 to 10 carbon atoms (e.g., acetylsulfamoyl group, propionylsulfamoyl group, pivaloylsulfamoyl group, and benzoylsulfamoyl group), a chain or cyclic alkyl group having 1 to 8 carbon atoms (e.g., methyl group, ethyl group, isopropyl group, butyl group, hexyl group, cyclopropyl group, cyclopentyl group, cyclohexyl group, 2-hydroxyethyl group, 4-carboxybutyl group, 2-methoxyethyl group, benzyl group, phenethyl group, 4-carboxybenzyl group, and 2-diethylaminoethyl group), an alkenyl group having 2 to 8 carbon atoms (e.g., vinyl group, and allyl group), an alkoxy group having 1 to 8 carbon atoms (e.g., methoxy group, ethoxy group, and butoxy group), a halogen atom (e.g., F, Cl, and Br), an amino group having 0 to 10 carbon atoms (e.g., unsubstituted amino group, dimethylamino group, diethylamino group, and carboxyethylamino group), an ester group having 2 to 10 carbon atoms (e.g., a methoxycarbonyl group), an amido group having 1 to 10 carbon atoms (e.g., acetylamino group, and benzamido group), a carbamoyl group having 1 to 10 carbon atoms (e.g., unsubstituted carbamoyl group, methylcarbamoyl group, and ethylcarbamoyl group), an aryl group having 6 to 10 carbon atoms (e.g., phenyl group, naphthyl group, hydroxyphenyl group, 4-carboxyphenyl group, 3-carboxyphenyl group, 3,5-dicarboxyphenyl group, 4-methanesulfonamidophenyl group, and 4-butanesulfonamidophenyl group), an aryloxy group having 6 to 10 carbon atoms (e.g., phenoxy group, 4-carboxyphenoxy group, 3-methylphenoxy group, and naphthoxy group), an alkylthio group having 1 to 8 carbon atoms (e.g., methylthio group, ethylthio group, and octylthio group), an arylthio group having 6 to 10 carbon atoms (e.g., phenylthio group, and naphthylthio group), an acyl group having 1 to 10 carbon atoms (e.g., acetyl group, benzoyl group, and propanoyl group), a sulfonyl group having 1 to 10 carbon atoms (e.g., methanesulfonyl group, and benzenesulfonyl group), a ureido group having 1 to 10 carbon atoms (e.g., ureido group, and methylureido group), a urethane group having 2 to 10 carbon atoms (e.g., methoxycarbonylamino group, and ethoxycarbonylamino group), a cyano group, a hydroxyl group, a nitro group, a heterocyclic group (e.g., 5-carboxybenzooxazole ring, pyridine ring, sulfolane ring, pyrrole ring, pyrrolidine ring, morpholine ring, piperazine ring, pyrimidine ring, and furan ring).

More preferable examples among the compounds represented by the above formula (III) are compounds represented by the following formula (IV). The compound represented by the formula (IV) has a hydrogen of an enol group as a dissociable hydrogen.

formula (IV)

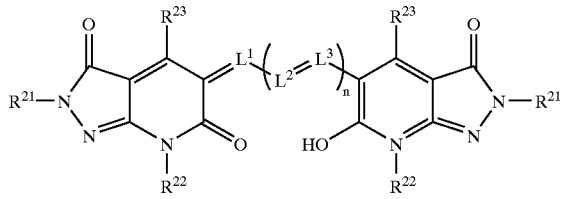

In the formula (IV), $R^{21}$ represents a hydrogen atom, an alkyl group, an aryl group, or a heterocyclic group, $R^{22}$ represents a hydrogen atom, an alkyl group, an aryl group, a heterocyclic group, —$COR^{24}$ or $SO_2R^{24}$, $R^{23}$ represents a hydrogen atom, a cyano group, a hydroxyl group, a carboxyl group, an alkyl group, an aryl group, —$CO_2R^{24}$, —$OR^{24}$, —$NR^{26}R^{26}$, —$CONR^{25}R^{26}$, —$NR^{25}COR^{24}$, —$NR^{25}SO_2R^{24}$ or —$NR^{25}CONR^{25}R^{26}$ (in which $R^{24}$ represents an alkyl group or an aryl group, and $R^{25}$ and $R^{26}$ each independently represents a hydrogen atom, an alkyl group, or an aryl group), $L^1$, $L^2$ and $L^3$ each independently represents a methine group, and n denotes 1 or 2.

In the above formula (IV), examples of the alkyl group as $R^{21}$ include an alkyl group having 1 to 4 carbon atoms, 2-cyanoethyl group, 2-hydroxyethyl group and carboxybenzyl group. Examples of the aryl group as $R^{21}$ include a phenyl group, 2-methylphenyl group, 2-carboxyphenyl group, 3-carboxyphenyl group, 4-carboxyphenyl group, 3,6-dicarboxyphenyl group, 2-hydroxyphenyl group, 3-hydroxyphenyl group, 4-hydroxyphenyl group, 2-chloro-4-carboxyphenyl group, and 4-methylsulfamoylphenyl group. Examples of the heterocyclic group as $R^{21}$ include 5-carboxybenzooxazole-2-yl group.

Examples of the alkyl group as $R^{22}$ include an alkyl group having 1 to 4 carbon atoms, carboxymethyl group, 2-hydroxyethyl group, and 2-methoxyethyl group. Examples of the aryl group as $R^{22}$ include a 2-carboxyphenyl group, 3-carboxyphenyl group, 4-carboxyphenyl group, and 3,6-dicarboxyphenyl group. Examples of the heterocyclic group as $R^{22}$ include a pyridyl group. Examples of —$COR^{24}$ as $R^{22}$ include an acetyl group, and examples of —$SO_2R^{24}$ as $R^{22}$ include a methanesulfonyl group.

Given as examples of the alkyl group as $R^{23}$, $R^{24}$, $R^{25}$ or $R^{26}$ are an alkyl group having 1 to 4 carbon atoms. Given as examples of the aryl group as $R^{23}$, $R^{24}$, $R^{25}$ or $R^{26}$ are a phenyl group and a methylphenyl group.

In the present invention, $R^{21}$ is preferably a phenyl group substituted with carboxyl group(s) (e.g., 2-carboxyphenyl group, 3-carboxyphenyl group, 4-carboxyphenyl group, and 3,6-dicarboxyphenyl group).

Specific examples of the compounds (I-1 to I-14, II-1 to II-25, III-1 to III-25, and IV-1 to IV-51) represented by any one of the above formulae (I) to (IV) are shown below, which, however, are not intended to be limiting of the present invention.

(I-1)
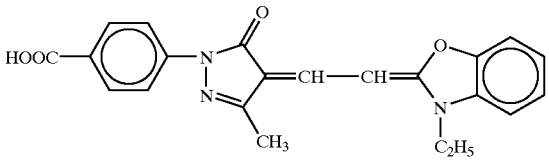
(I-2)
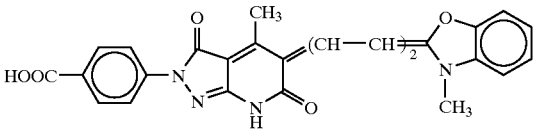
(I-3)
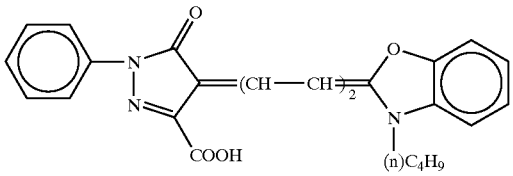
(I-4)
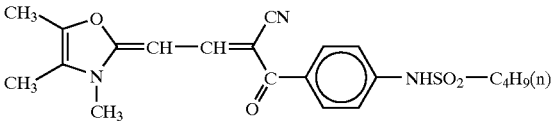
(I-5)
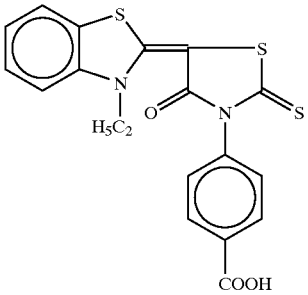
(I-6)
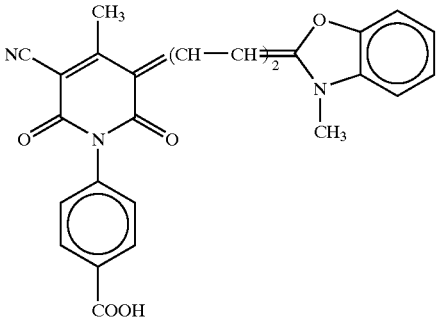
(I-7)
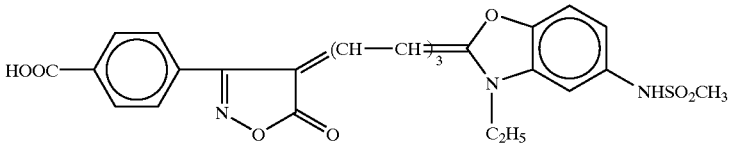
(I-8)
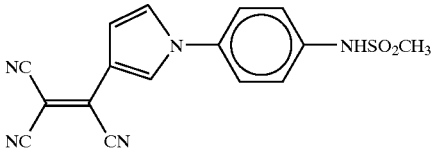
(I-9)
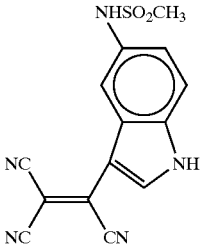
(I-10)
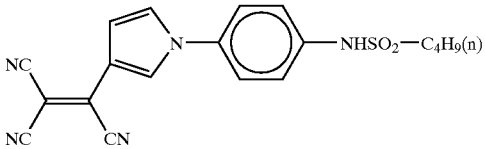
(I-11)
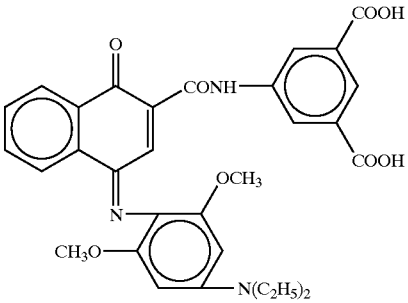

-continued
(I-12)
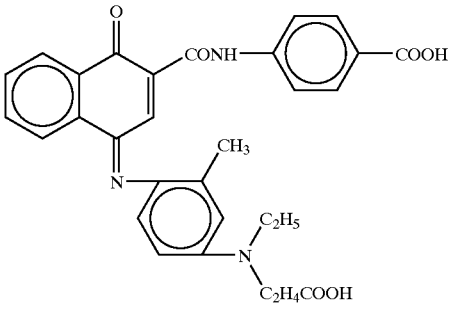
(I-13)
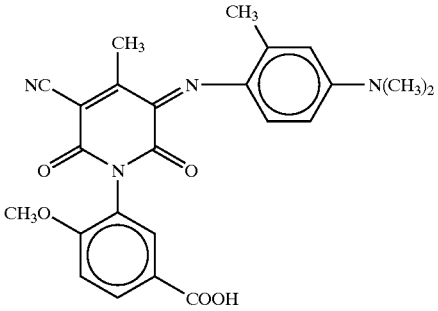
(I-14)
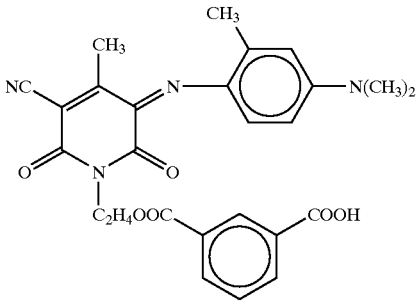
(II-1)
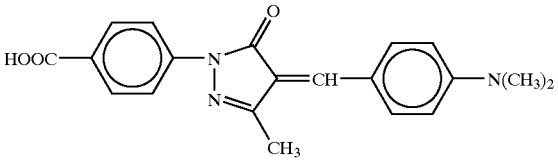
(II-2)
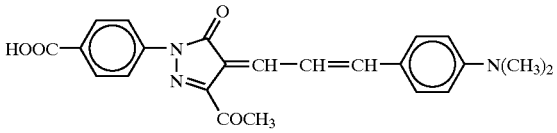
(II-3)
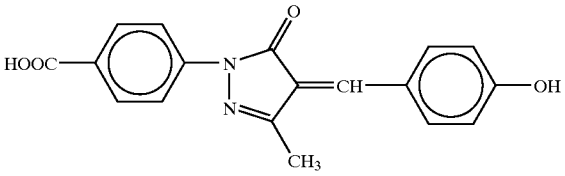
(II-4)
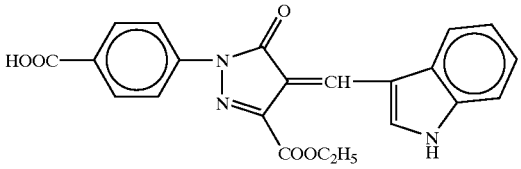
(II-5)
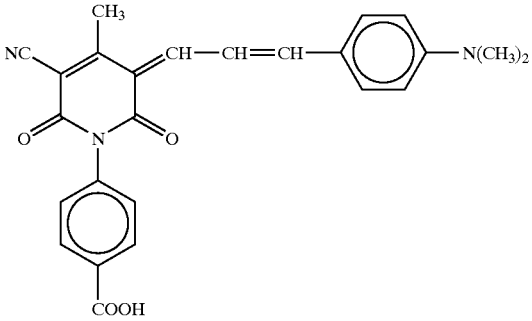
(II-6)
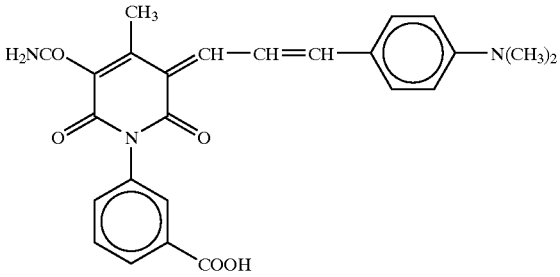
(II-7)
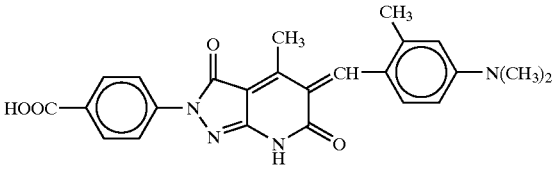

-continued
(II-8)
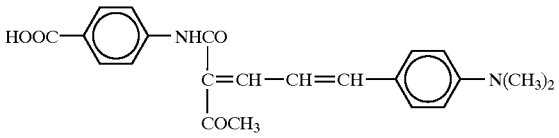
(II-9)
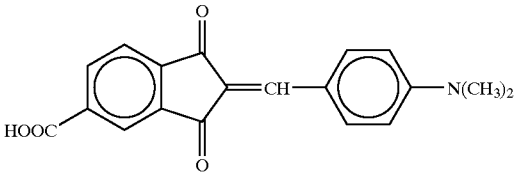
(II-10)
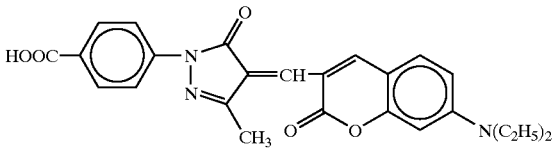
(II-11)
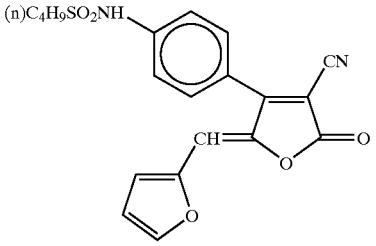
(II-12)
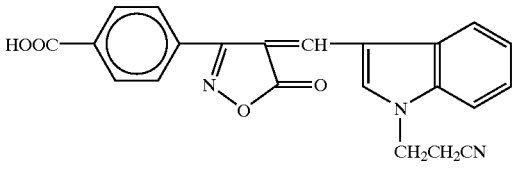
(II-13)
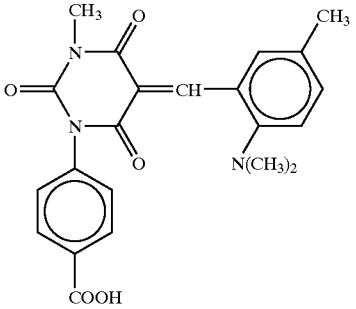
(II-14)
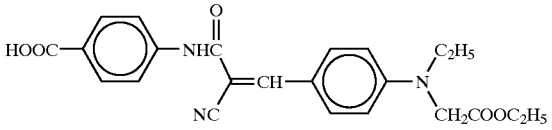
(II-15)
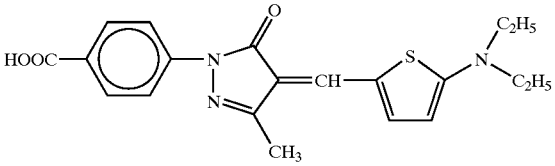
(II-16)
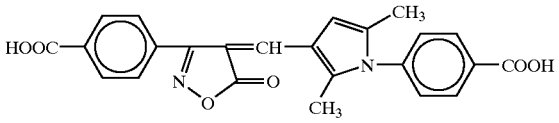
(II-17)
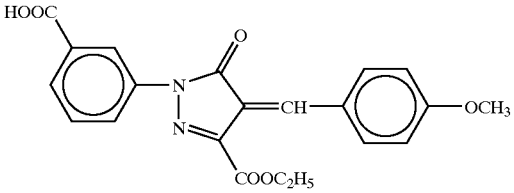
(II-18)
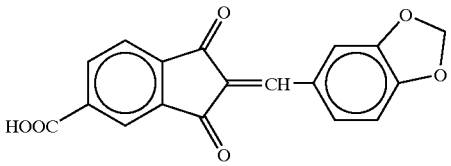
(II-19)
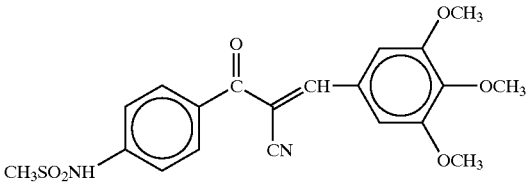

-continued
(II-20)
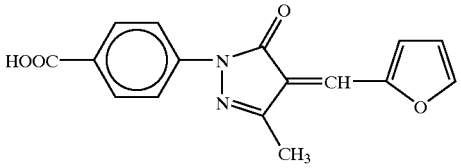
(II-21)
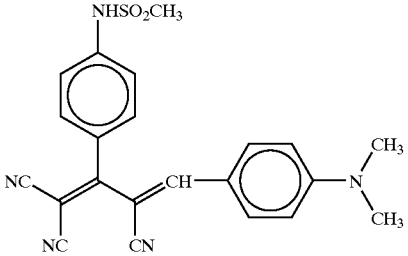
(II-22)
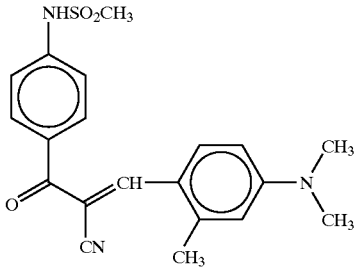
(II-23)
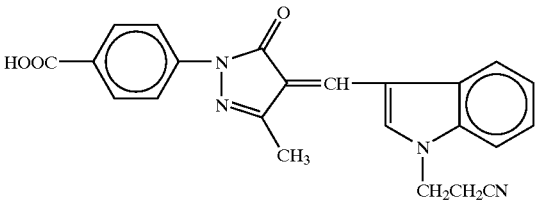
(II-24)
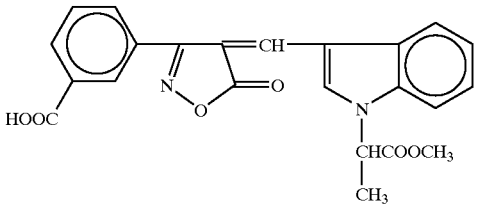
(II-25)
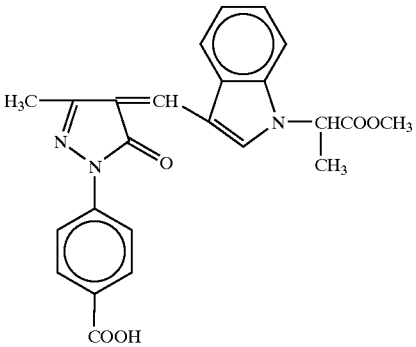
(III-1)
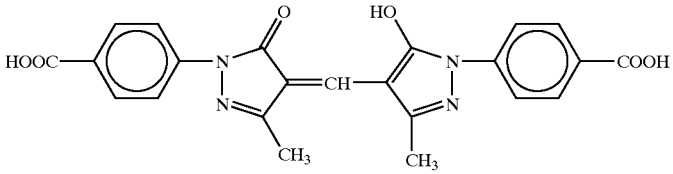
(III-2)
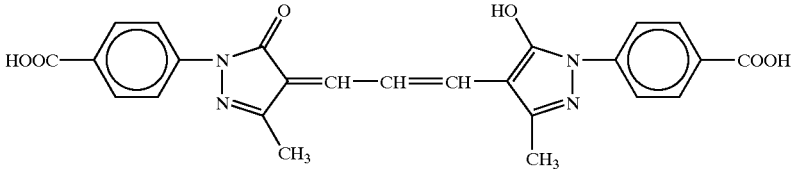
(III-3)
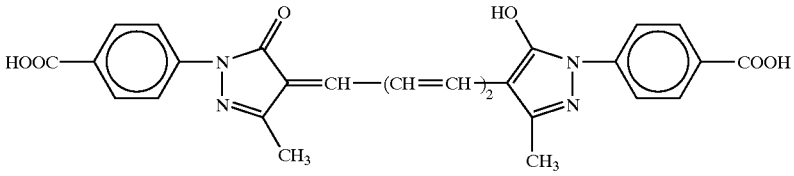
(III-4)
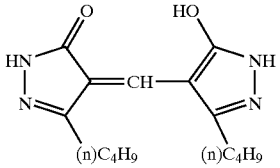
(III-5)
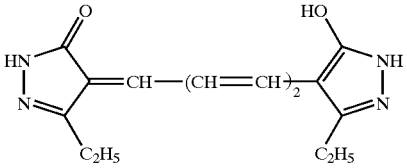

-continued
(III-6)
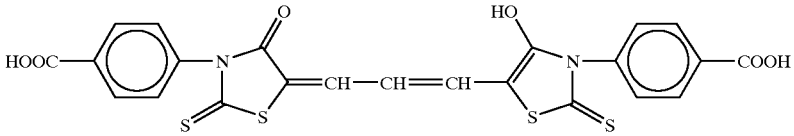
(III-7)
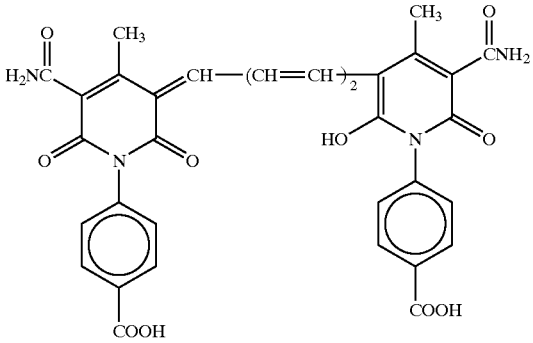
(III-8)
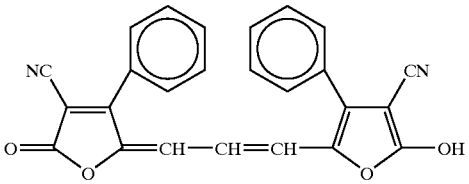
(III-9)
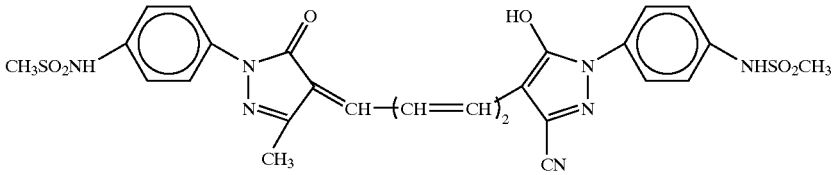
(III-10)
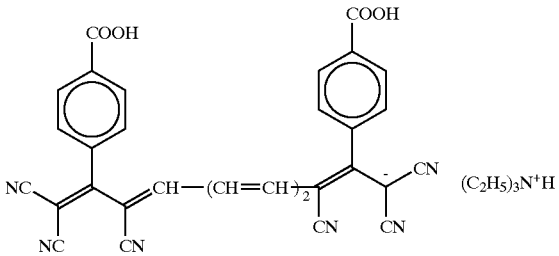
(III-11)
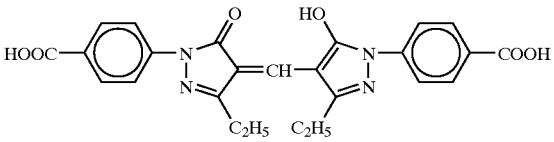
(III-12)
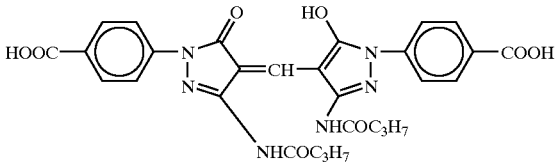
(III-13)
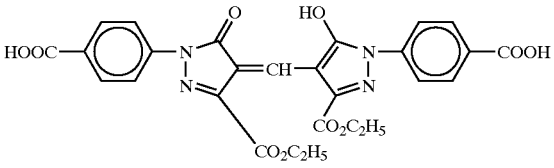
(III-14)
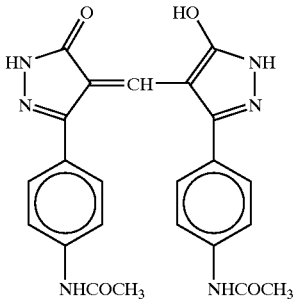
(III-15)
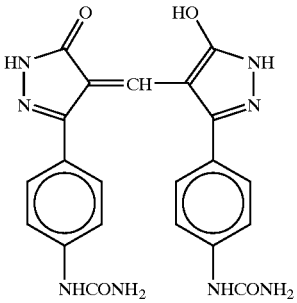

-continued
(III-16)
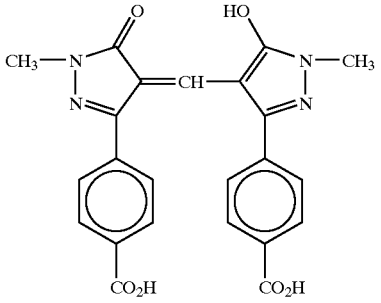
(III-17)
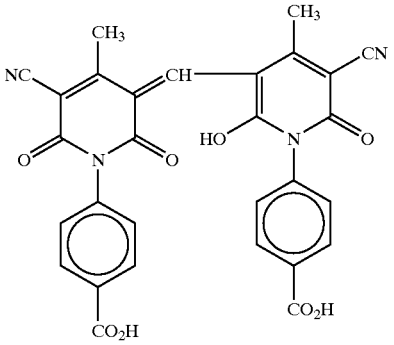
(III-18)
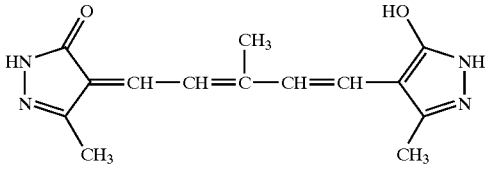
(III-19)
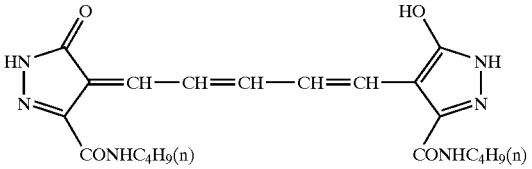
(III-20)
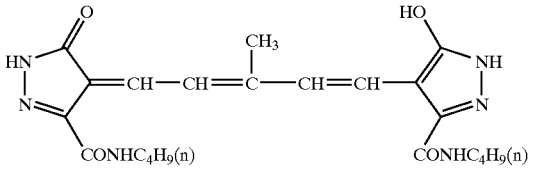
(III-21)
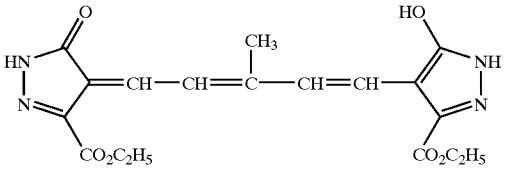
(III-22)
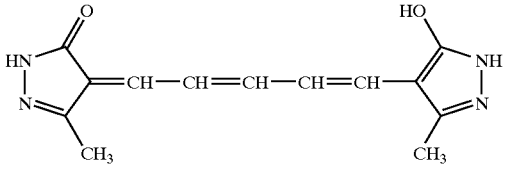
(III-23)
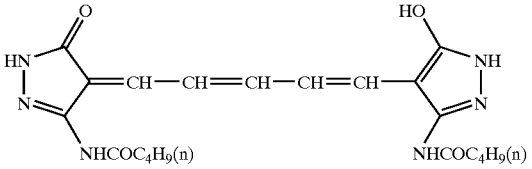
(III-24)
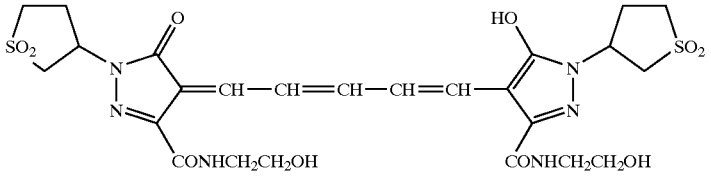
(III-25)
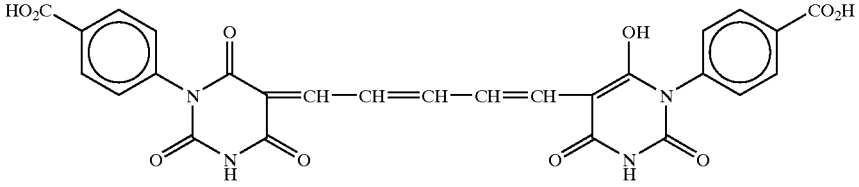

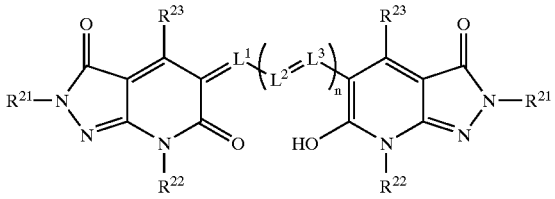
| | $R^{21}$ | $R^{22}$ | $R^{23}$ | $=L^1-(L^2=L^3)_n-$ |
|---|---|---|---|---|
| IV-1 | 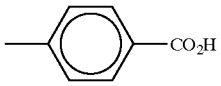 | —H | $-CH_3$ | =CH—CH=CH— |
| IV-2 | 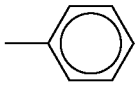 | —H | $-CH_3$ | =CH—CH=CH— |
| IV-3 | $-CH_3$ | —H | $-CH_3$ | =CH—CH=CH— |
| IV-4 | 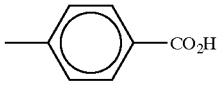 | $-CH_3$ | $-CH_3$ | =CH—CH=CH— |
| IV-5 | 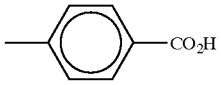 | 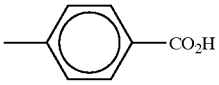 | $-CH_3$ | =CH—CH=CH— |
| IV-6 | 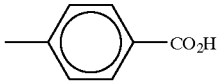 | $-CH_3$ | $-CO_2C_2H_5$ | =CH—CH=CH— |
| IV-7 | 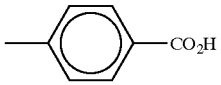 | $-CH_3$ | $-CO_2H$ | =CH—CH=CH— |
| IV-8 | $-CH_3$ | 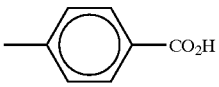 | $-CH_3$ | =CH—CH=CH— |
| IV-9 | $-CH_3$ | 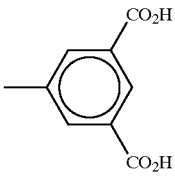 | $-CH_3$ | =CH—CH=CH— |
| IV-10 | $-CH_3$ | $-CH_3$ | $-CH_3$ | =CH—CH=CH— |
| IV-11 | 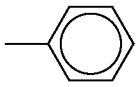 | 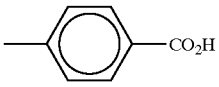 | $-CH_3$ | =CH—CH=CH— |
| IV-12 | 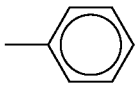 | 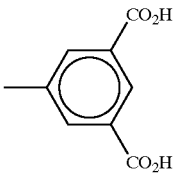 | $-CH_3$ | =CH—CH=CH— |

-continued
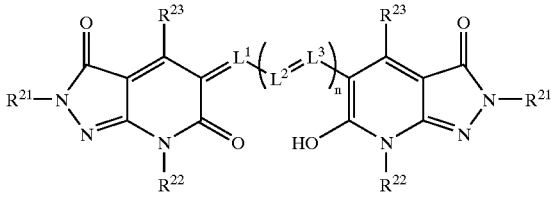
| | $R^{21}$ | $R^{22}$ | $R^{23}$ | $=L^1-(L^2=L^3)_n-$ |
|---|---|---|---|---|
| IV-13 | 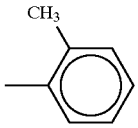 | 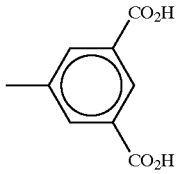 | $-CH_3$ | $=CH-CH=CH-$ |
| IV-14 | 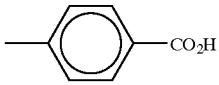 | $-H$ | $-CH_3$ | 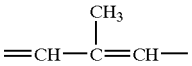 |
| IV-15 | 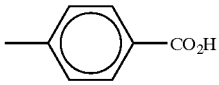 | $-H$ | $-CO_2C_2H_5$ | $=CH-CH=CH-$ |
| IV-16 | 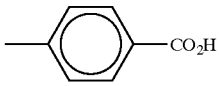 | $-H$ | $-CO_2H$ | $=CH-CH=CH-$ |
| IV-17 | 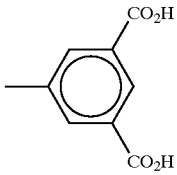 | $-H$ | $-CH_3$ | $=CH-CH=CH-$ |
| IV-18 | 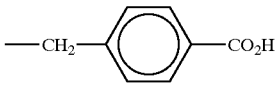 | $-H$ | $-CH_3$ | 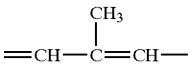 |
| IV-19 | 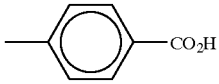 | $-CH_2CH_2OH$ | $-H$ | $=CH-CH=CH-$ |
| IV-20 | 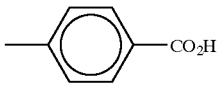 | $-CH_2CO_2H$ | $-CH_3$ | 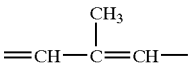 |
| IV-21 | 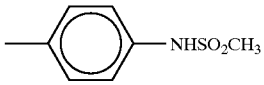 | $-H$ | $-CH_3$ | $=CH-CH=CH-$ |
| IV-22 | 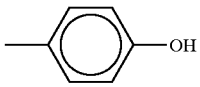 | $-H$ | $-CH_3$ | $=CH-CH=CH-$ |
| IV-23 | $-CH_2CH_2OH$ | $-H$ | $-CH_3$ | $=CH-CH=CH-$ |
| IV-24 | $-CH_3$ | $-CH_2CH_2OH$ | $-CH_3$ | $=CH-CH=CH-$ |
| IV-25 | $-H$ | 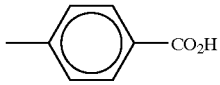 | $-CH_3$ | $=CH-CH=CH-$ |
| IV-26 | $-H$ | $-H$ | $-CO_2H$ | $=CH-CH=CH-$ |

-continued
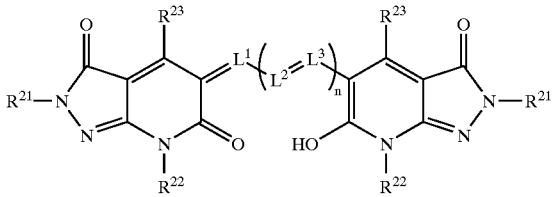
| | $R^{21}$ | $R^{22}$ | $R^{23}$ | $=L^1-(L^2=L^3)_n-$ |
|---|---|---|---|---|
| IV-27 | 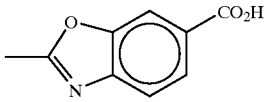 | —H | $-C_2H_5$ | =CH—CH=CH— |
| IV-28 | 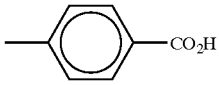 | $-SO_2CH_3$ | $-CO_2CH_3$ | 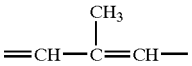 |
| IV-29 | 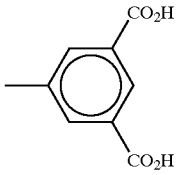 | $-COCH_3$ | $-CH_3$ | =CH—CH=CH— |
| IV-30 | —H | 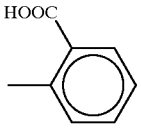 | $-CH_3$ | =CH—CH=CH— |
| IV-31 | 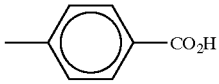 | 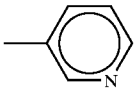 | $-CH_3$ | 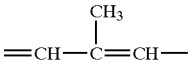 |
| IV-32 | 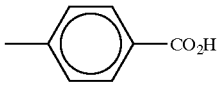 | $-CH_3$ | —CN | =CH—CH=CH— |
| IV-33 | 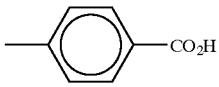 | —H | —H | =CH—CH=CH— |
| IV-34 | 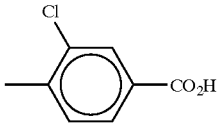 | —H | $-OC_2H_5$ | =CH—CH=CH— |
| IV-35 | 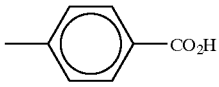 | —H | $(n)C_4H_9-$ | =CH—CH=CH— |
| IV-36 | 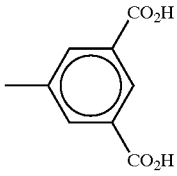 | $-CH_3$ | $-NHCH_3$ | =CH—CH=CH— |

-continued
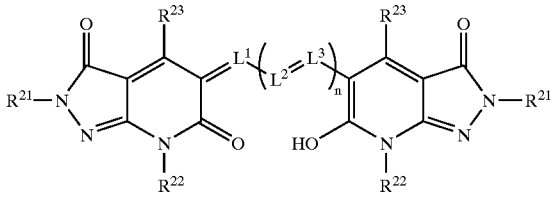
| | $R^{21}$ | $R^{22}$ | $R^{23}$ | $=L^1-(L^2=L^3)_n-$ |
|---|---|---|---|---|
| IV-37 | 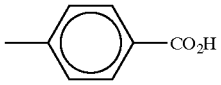 | $-COCH_3$ | $-NHCOCH_3$ | $=CH-CH=CH-$ |
| IV-38 | 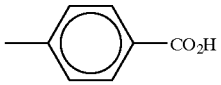 | $-CO_2CH_3$ | $-NHSO_2CH_3$ | $=CH-CH=CH-$ |
| IV-39 | 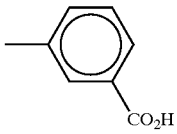 | $-CH_2CH_2OH$ | $-CH_3$ | $=CH-CH=CH-$ |
| IV-40 | $-CH_2CH_2CN$ | $-H$ | $-CH_3$ | $=CH-CH=CH-$ |
| IV-41 | 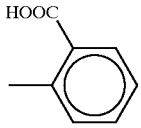 | $-H$ | $-CH_3$ | $=CH-CH=CH-$ |
| IV-42 | 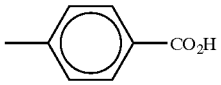 | $-H$ | $-C_2H_5$ | $=CH-CH=CH-$ |
| IV-43 | 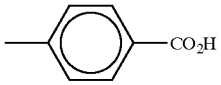 | $-CH_2CH_2OCH_3$ | $-CH_3$ | 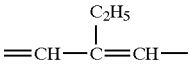 |
| IV-44 | 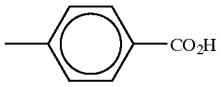 | $-H$ | $-CH_3$ | 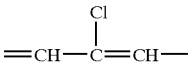 |
| IV-45 | 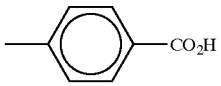 | $-H$ | $-CO_2H$ | 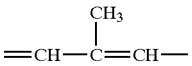 |
| IV-46 | 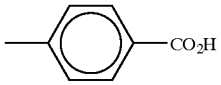 | $-H$ | $-CO_2H$ | 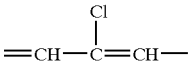 |
| IV-47 | $-CH_2CH_2CN$ | 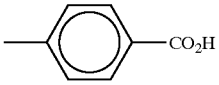 | $-CH_3$ | $=CH-CH=CH-$ |
| IV-48 | $-CH_2CH_2CN$ | 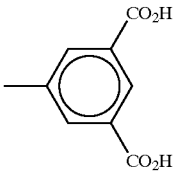 | $-CH_3$ | $=CH-CH=CH-$ |

-continued

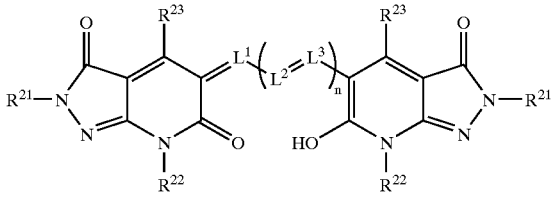

| | $R^{21}$ | $R^{22}$ | $R^{23}$ | $=L^1-(L^2=L^3)_n-$ |
|---|---|---|---|---|
| IV-49 | 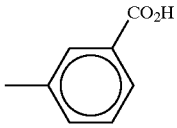 | —H | $-CH_3$ | =CH—CH=CH— |
| IV-50 | 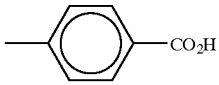 | —H | $-CH_3$ | =CH—CH=CH—CH=CH— |
| IV-51 | $-CH_3$ | 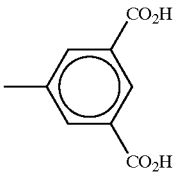 | $-CH_3$ | =CH—CH=CH—CH=CH— |

The dyes for use in the present invention may be synthesized by or according to the methods described in WO88/04794, European Patent Applications Laid-open No. 274,723A1, No. 276,566, and No. 299,435, JP-A-52-92716, JP-A-55-155350, JP-A-55-155351, JP-A-61-205934, JP-A-48-68623, U.S. Pat. No. 2,527,583, No. 3,486,897, No. 3,746,539, No. 3,933,798, No. 4,130,429 and No. 4,040,841, JP-A-3-282244, JP-A-3-7931, JP-A-3-167546, and the like.

The solid fine-particle dispersion of the dye that can be used in the present invention may be prepared by known methods. Details of the production methods are described in "Kinousei-Ganryo Oyogijutsu (Functional Pigment Applied Technologies)" (published by CMC, 1991) and the like.

Dispersion using media is one of general methods. In this method, a dye powder or a dye wetted by water or an organic solvent (so-called wet cake) is made into an aqueous slurry, and the resulting slurry is mechanically crushed in the presence of a dispersing medium (e.g., steel balls, ceramic balls, glass beads, alumina beads, zirconia silicate beads, zirconia beads or Ottawa sand) with an arbitrary crusher (e.g., ball mill, vibrating ball mill, planetary ball mill, vertical type sand mill, roller mill, pin mill, coball mill, caddy mill, horizontal sand mill, attritor, or the like). Among these, the average diameter of beads to be used is preferably 2 mm to 0.3 mm, more preferably 1 mm to 0.3 mm, and still more preferably 0.5 mm to 0.3 mm. In addition to the above methods, methods of crushing using a jet mill, roll mill, homogenizer, colloid mill or desolver, or crushing methods using a ultrasonic dispersion machine may be used.

Also, a method in which a dye is dissolved in a uniform solution and thereafter a poor solvent is added to the solution to precipitate solid fine particles, as disclosed in U.S. Pat. No. 2,870,012, or a method in which a dye is dissolved in an alkaline solution and thereafter the pH of the solution is dropped to precipitate solid fine particles, as disclosed in JP-A-3-182743, may be used.

When the solid fine-particle dispersion is prepared, a dispersing aid is preferably made to be present. Examples of dispersing aids which have been disclosed include anionic dispersants, such as alkylphenoxyethoxy sulfonates, alkylbenzene sulfonates, alkylnaphthalene sulfonates, alkylsulfate esters/salts, alkyl sulfosuccinates, sodium oleylmethyl taurides, formaldehyde condensation polymers of naphthalenesulfonic acids, polyacrylic acids, polymethacrylic acids, maleic acid/acrylic acid copolymers, carboxymethyl celluloses and cellulose sulfates; nonionic dispersants, such as polyoxyethylene alkyl ethers, sorbitan fatty acid esters, and polyoxyethylenesorbitan fatty acid esters; cationic dispersants and betaine-series dispersants. Particularly, a polyalkylene oxide represented by the following formula (V-a) or (V-b) is preferably used as the dispersing aid.

formula (V-a)

$$HO-(CH_2CH_2O)_a-(CH_2\underset{\underset{CH_3}{|}}{C}HO)_b-(CH_2CH_2O)_a-H$$

formula (V-b)

$$HO-(CH_2\underset{\underset{CH_3}{|}}{C}HO)_b-(CH_2CH_2O)_a-(CH_2\underset{\underset{CH_3}{|}}{C}HO)_b-H$$

In the above formulae (V-a) and (V-b), a and b respectively denote a value of 5 to 500. a and b respectively are preferably 10 to 200, and more preferably 50 to 150. It is preferable to have a and b in the above range, in view of improving the uniformity of the applied surface.

In the above dispersing aid, the ratio in terms of mass ratio of the polyethylene oxide part is preferably 0.3 to 0.9, more preferably 0.7 to 0.9, and still more preferably 0.8 to 0.9. Also, the average molecular mass of the above dispersing aid is preferably 1,000 to 40,000, more preferably 5,000 to 30,000, and still more preferably 8,000 to 20,000. Further, the HLB (hydrophilicity/lipophilicity balance) of the above dispersing aid is preferably 7 to 30, more preferably 12 to 30, and still more preferably 18 to 30. It is preferable to have the HLB value in the above range, in view of improving the uniformity of the applied surface.

These compounds are commercially available, for example, as Pluronic (trade name) manufactured by BASF.

Specific examples of the compound represented by the above formula (V-a) or (V-b) will be hereinafter described $$HO-(CH_2CH_2O)_a-(CH_2\underset{\underset{CH_3}{|}}{C}HO)_b-(CH_2CH_2O)_a-H$$

formula (V-a)

| No. | Mass ratio of polyethylene oxide | Average molecular mass | HLB |
|---|---|---|---|
| V-1 | 0.5 | 1900 | ≧18 |
| V-2 | 0.8 | 4700 | ≧20 |
| V-3 | 0.3 | 1850 | 7~12 |
| V-4 | 0.4 | 2200 | 12~18 |
| V-5 | 0.4 | 2900 | 12~18 |
| V-6 | 0.5 | 3400 | 12~18 |
| V-7 | 0.8 | 8400 | ≧20 |
| V-8 | 0.7 | 6600 | ≧20 |
| V-9 | 0.4 | 4200 | 12~18 |
| V-10 | 0.5 | 4600 | 12~18 |
| V-11 | 0.7 | 7700 | ≧20 |
| V-12 | 0.8 | 11400 | ≧20 |
| V-13 | 0.8 | 13000 | ≧20 |
| V-14 | 0.3 | 4950 | 7–12 |
| V-15 | 0.4 | 5900 | 12~18 |
| V-16 | 0.5 | 6500 | 12~18 |
| V-17 | 0.8 | 14600 | ≧200 |
| V-18 | 0.3 | 5750 | 7~12 |
| V-19 | 0.7 | 12600 | ≧18 |

$$HO-(CH_2\underset{\underset{CH_3}{|}}{C}HO)_b-(CH_2CH_2O)_a-(CH_2\underset{\underset{CH_3}{|}}{C}HO)_b-H$$

formula (V-b)

| No. | Mass ratio of polyethylene oxide | Average molecular mass | HLB |
|---|---|---|---|
| V-20 | 0.5 | 1950 | 12~18 |
| V-21 | 0.4 | 2650 | 7~12 |
| V-22 | 0.4 | 3600 | 7~12 |
| V-23 | 0.8 | 8600 | 12~18 |

In the present invention, the amount of the above dispersing aid to be used is preferably 0.05 to 0.5, and more preferably 0.1 to 0.3, in terms of mass ratio to the above dye. It is preferable to have the amount of the dispersing aid to be used in the above range, in view of improving the uniformity of the applied surface.

Also, at the time of preparation of the solid fine-particle dispersion, a polyvinyl alcohol, polyvinylpyrrolidone, polyethylene glycol, polysaccharides, or hydrophilic colloid, such as a gelatin, may coexist for the purpose of stabilizing the dispersion and decreasing the viscosity of the dispersion. In the present invention, it is particularly preferable to allow the compound of the formula (VI) explained later to coexist.

The solid fine-particle dispersion of the dye, which is preferably used in the present invention, is preferably those treated under heat before, during, or after dispersion, by such a method as described in JP-A-5-216166.

From the viewpoint of the effects of the present invention, the dye according to the present invention is preferably treated under heat at 40° C. or more (more preferably 60° C. or more), before it is incorporated into the light-sensitive material. Examples of the heat treatment method that is preferably applicable to the dye dispersion, include a method in which the heat treatment is performed prior to a step of micro-dispersing solid-wise, for example, by heating a dye powder in a solvent; a method in which a dye is dispersed without cooling the dye or with heating the dye, when the dye is dispersed in water or other solvents, in the presence of a dispersant; and a method in which a solution after dispersion of the dye or an coating solution is treated under heat. It is particularly preferable to carry out the heat treatment after the dye is dispersed.

When two or more kinds of the solid fine-particle dispersion containing the dye represented by the formula (I) are used in a specific layer, at least one dispersion may be heat-treated.

The pH in heat treatment during or after dispersion of the dye may be in a range required for the dispersion to exist stably, and it is preferably in a range of 2.0 to 8.0, more preferably 2.0 to 6.5, and still more preferably 2.5 or more but less than 4.5. The pH during heat treatment that is in the above range is preferable, in view of an improvement in the film strength of the coating material.

For the adjustment of the pH of the dispersion, for example, sulfuric acid, hydrochloric acid, acetic acid, citric acid, phosphoric acid, oxalic acid, carbonic acid, sodium bicarbonate, sodium carbonate, sodium hydroxide, potassium hydroxide or a buffer comprising thereof may be used.

The temperature in the above heat treatment may be arbitrary selected, as far as it is in a range that is 40° C. or higher and is a temperature at which the dye is not decomposed, although it can not be determined in a wholesale manner because it differs depending upon the step at which heat treatment is conducted, the size and shape of a powder or particle, heat treating conditions, the type of solvent, and the like. In the case of heat-treating a powder, an appropriate temperature is generally 40 to 200° C., and preferably 50 to 150° C. In the case of heat-treating in a solvent, an appropriate temperature is generally 40 to 150° C., and preferably 50 to 150° C. In the case of heat-treating during dispersion, an appropriate temperature is generally 40 to 90° C., and preferably 50 to 90° C. In the case of heat-treating the dispersion solution after a dispersing step is finished, an appropriate temperature is generally 40 to 100° C., preferably 50 to 95° C., more preferably 60 to 95° C., and particularly preferably 70 to 95° C. When the temperature at heat treatment is too low, only a poor effect is obtained.

When the heat-treatment is carried out in a solvent, there is no limitation to the type of solvent as far as it does not substantially dissolve the dye. Examples of the solvent include water, alcohols (e.g., methanol, ethanol, isopropyl alcohol, butanol, isoamyl alcohol, octanol, ethylene glycol, diethylene glycol, and ethyl cellosolve), ketones (e.g., acetone, and methyl ethyl ketone), esters (e.g., ethyl acetate and butyl acetate), alkylcarboxylic acids (e.g., acetic acid and propionic acid), nitrites (e.g., acetonitrile), ethers (e.g., dimethoxyethane, dioxane and tetrahydrofuran), amides (e.g., dimethylformamide), and the like.

Even if a solvent dissolves the dye when it is used singly, such a solvent can be used if the dye is not substantially dissolved to a solution obtained by mixing the solvent with water or other solvents, or by adjusting the pH.

The time required for heat treatment also can not be determined in a wholesale manner. When the temperature is low, a long time is required, whereas when the temperature is high, only a short time is required. The heat-treating time can be determined arbitrary as far as the heat treatment is conducted within the range free from an adverse effect on the production process, and the heat-treating time is preferably one hour to 4 days in general.

The fine particles prepared in this manner are dispersed in an appropriate binder to prepare a solid dispersion of almost uniform particles, and then the dispersion is applied to a desired support, to form a layer containing the fine particles of the dye on the photographic light-sensitive material.

As the above binder, a gelatin, or a synthetic polymer, such as a polyvinyl alcohol or polyacryl amide, is usually used, although no particular limitation is imposed on the binder as far as it is a hydrophilic colloid, which can be used for light-sensitive emulsion layers or non-light-sensitive layers.

The fine particles in the solid dispersion have an average particle diameter of generally 0.005 to 10 μm, preferably 0.01 to 1 μm, and more preferably 0.01 to 0.7 μm. The particle diameter falling in this range is preferable in view of resistance to coagulation of the fine particles and of light-absorbing efficiency. The solid fine-particle dispersion of the dye represented by the above formula (I) may be used singly or in combination with a plurality of solid fine-particle dispersions.

Moreover, the number of the hydrophilic colloidal layers to which the solid fine particle is to be added may be either one or plural. Examples include a case where a single solid fine-particle dispersion is added to only one layer, a case where a single solid fine-particle dispersion is added to plural layers in lots, a case where plural solid fine-particle dispersions are added to only one layer simultaneously, and a case where plural solid fine-particle dispersions are respectively added to separate layers. These cases, however, are not intended to be limiting of the present invention.

Further, the solid fine-particle dispersion may be incorporated as an anti-halation layer in a necessary amount and further added to a light-sensitive silver halide emulsion layer in a necessary amount for the prevention of irradiation.

The hydrophilic colloidal layer containing the solid fine-particle dispersion of the dye represented by the formula (I), which is preferably used in the present invention, is preferably disposed between the support and a silver halide emulsion layer closest to the support. A non-light-sensitive hydrophilic colloidal layer other than the hydrophilic colloidal layer containing the solid fine-particle dispersion may be disposed between the support and a silver halide emulsion layer closest to the support.

The solid fine-particle dispersion of the dye preferably used in the present invention is generally contained in a non-light-sensitive hydrophilic colloidal layer according to the hue of the dye, in the silver halide photographic light-sensitive material. In a light-sensitive material according to an embodiment provided with a plurality of non-light-sensitive layers, the solid fine-particle dispersion may be added to the plurality of layers.

The concentration of the dye in the above solid fine-particle dispersion is generally 0.1 to 50 mass %, and preferably 2 to 30 mass %. The concentration of the dye that falls in the above range is preferable, in view of the viscosity of the dispersion. Further, the amount of the solid fine-particle dye to be applied is preferably 2 about 0.05 to 0.5 $g/m^2$.

In the present invention, a compound represented by the following formula (VI) is preferably contained together with the above solid fine-particle dispersion, in the same photographic constitutional layer.

$$P—((S)_m—R)_n \qquad \text{Formula (VI)}$$

In the formula (VI), R represents a hydrogen atom, a hydrophobic group or a hydrophobic polymer, P represents a polymer containing at least one of the following units A, B and C, and having a polymerization degree of 10 or more and 3500 or less, n denotes 1 or 2, and m denotes 1 or 0;

A:

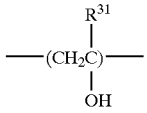

B:

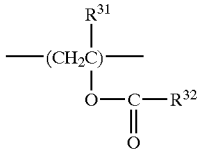

C:

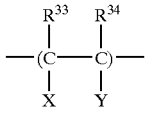

wherein $R^{31}$ represents —H or an alkyl group having 1 to 6 carbon atoms, $R^{32}$ represents —H or an alkyl group having 1 to 10 carbon atoms, $R^{33}$ represents —H or —$CH_3$, $R^{34}$ represents H, —$CH_3$, —$CH_2COOH$ (including an ammonium salt or a metal salt) or —CN, X represents —H, —COOH (including an ammonium salt or a metal salt) or —$CONH_2$, Y represents —COOH (including an ammonium salt or a metal salt), —$SO_3H$ (including an ammonium salt or a metal salt), —$OSO_3H$ (including an ammonium salt or a metal salt), —$CH_2SO_3H$ (including an ammonium salt or a metal salt), —$CONHC(CH_3)_2CH_2SO_3H$ (including an ammonium salt or a metal salt) or —$CONHCH_2CH_2CH_2N^+(CH_3)_3Cl^-$.

Details of the compound represented by the above formula (VI) (e.g., concrete explanations, limitations of preferable ranges, exemplified compounds, amount to be used, and synthetic methods) are described in JP-A-11-95371, from page 24, column 46, line 27 to page 33, column 63, line 2 (Paragraphs 0090 to 0128), and the corresponding part of the publication is incorporated herein as a part of the present specification.

The silver halide color photographic light-sensitive material of the present invention is generally processed by a development treatment which is usually used.

Particularly, in the processing of a motion picture silver halide color photographic light-sensitive material, a motion picture positive light-sensitive material can be processed in a conventionally used processing step as shown below. Further, in the case of the motion picture positive light-sensitive material according to the present invention, each step of (1) Pre-bath and (2) Wash bath, for removing a resin backing layer can be omitted. Such a shortened processing step is particularly preferable to simplify the process.

Also, when a soundtrack is formed by a dye image, each step of (6) First fixing bath, (7) Wash bath, (11) Sound development and (12) Washing can be omitted, leading to an excellently preferable embodiment in view of simplification of the process. The silver halide light-sensitive material of the present invention can exhibit excellent properties in such a simple processing step.

Conventional standard processing steps for a motion picture positive light-sensitive material (except for a drying process):

(1) Pre-bath
(2) Wash bath
(3) Color developing bath
(4) Stop bath
(5) Wash bath
(6) First fixing bath
(7) Wash bath
(8) Bleaching accelerating bath
(9) Bleaching bath
(10) Wash bath
(11) Sound development (coating development)
(12) Washing
(13) Second fixing bath
(14) Wash bath
(15) Stabilizing bath In the present invention, generally, when color developing time (the above step (3)) is 2 minutes and 30 seconds or less (the lower limit is preferably 6 seconds or more, more preferably 10 seconds or more, further more preferably 20 seconds or more, and most preferably 30 seconds or more), and more preferably 2 minutes or less (the lower limit is the same to the case for the color development time of 2 minutes and 30 seconds), the effects of the present invention are remarkable, and therefore such a developing time is preferable.

Next, the photographic layers and the like of the silver halide color photographic light-sensitive material of the present invention will be described.

The silver halide color photographic light-sensitive material of the present invention is a silver halide color photographic light-sensitive material having a transmissive support, and it has at least one light-sensitive layer comprising a plurality of silver halide emulsion layers differing substantially in color sensitivity, on the transmissive support. The silver halide color photographic light-sensitive material of the present invention may be applied to color photographic light-sensitive materials for common uses and motion pictures, such as color positive films, motion picture positive films, and the like.

It is preferable to apply the silver halide color photographic light-sensitive material of the present invention to a motion picture color positive light-sensitive material.

In the present invention, there is no particular limitation to the number and order of light-sensitive silver halide emulsion layer(s) and non-light-sensitive hydrophilic colloid layer(s). Each of the yellow, cyan, and magenta color forming light-sensitive silver halide emulsion layers may be one light-sensitive silver halide emulsion layer or a plurality of silver halide emulsion layers having the same color sensitivity but differing in sensitivity (speed).

There is also no particular limitation to the relation between the color-forming ability and color sensitivity of each of the color-forming light-sensitive silver halide emulsion layers. For example, one color-forming light-sensitive silver halide emulsion layer may have color sensitivity in the infrared region.

A typical example of the order of layers is as follows: an order, from the support, a non-light-sensitive hydrophilic colloidal layer that comprises the solid fine-particle dispersion of the dye for use in the present invention, a yellow color-forming light-sensitive silver halide emulsion layer, a non-light-sensitive hydrophilic colloidal layer (color-mixing prevention layer), a cyan color-forming light-sensitive silver halide emulsion layer, a non-light-sensitive hydrophilic colloidal layer (color-mixing prevention layer), a magenta color-forming light-sensitive silver halide emulsion layer, and a non-light-sensitive hydrophilic colloidal layer (protective layer). However, the aforementioned arranging order may be changed and the number of light-sensitive silver halide emulsion layers and non-light-sensitive hydrophilic colloidal layers may be increased or decreased according to the purpose.

In the present invention, gelatin is preferably used as a hydrophilic colloid. Further, other hydrophilic colloid besides gelatin can also be used with replacing gelatin in an arbitrary ratio. Examples include gelatin derivatives, graft polymers of gelatin with another polymer, proteins such as albumin and casein; cellulose derivatives, such as hydroxyethyl celluloses, carboxymethyl celluloses, and cellulose sulfates; sodium alginates, saccharides, such as starch derivatives; and various synthetic polymers, including polyvinyl alcohols, polyvinyl alcohol partial acetals, poly-N-vinylpyrrolidones, polyacrylic acids, polymethacrylic acids, polyacrylamides, polyvinylimidazoles, and polyvinylpyrazoles.

The silver halide grains for use in the present invention includes, silver chloride, silver bromide, silver (iodo) chlorobromide, silver iodobromide, and the like. Particularly, in the present invention, in view of reducing development processing time, it is preferable to use silver chloride, silver chlorobromide, silver chloroiodide, silver chloroiodobromide, each having silver chloride content of 95 mol % or more. The silver halide grains in the emulsion may be those comprising regular crystals having, for example, a cubic, octahedron, or tetradecahedron form, those comprising irregular crystals having, for example, a spherical or plate form, those having crystal defects such as a twin plane, or complex systems of these crystals. Also, use of a tabular grain having a (111) plane or a (100) plane as its principal face, is preferable in view of achieving rapid color development processing and decreasing color contamination in the processing. The tabular high-silver-chloride emulsion grains having a (111) plane or a (100) plane as its principal face may be prepared by the methods disclosed in JP-A-6-138619, U.S. Pat. No. 4,399,215, No. 5,061,617, No. 5,320,938, No. 5,264,337, No. 5,292,632, No. 5,314,798, and No. 5,413,904, WO94/22051, and the like.

As a silver halide emulsion which can be used in combination with the above emulsions, in the present invention, any silver halide emulsion having an arbitrary halogen composition may be used. However, in view of rapid processability, silver (iodo)chloride and silver chloro(iodo) bromide, having 95 mol % or more of silver chloride are preferable, and further, a silver halide emulsion having 98 mol % or more of silver chloride in the same manner as the emulsion according to the present invention is preferable.

A silver halide grain in the photographic emulsion may be, in the same manner as those in the emulsions in the present invention, those having a regular crystal form such as a cubic, octahedron or tetradecahedron form, those having crystal defects such as a twin plane, or complex system thereof.

As to the grain diameter of the silver halide, either fine grains having a grain diameter of about 0.2 $\mu$m or less, or large-size grains whose projected area diameter is up to about 10 $\mu$m, may be adopted, and further it may be a polydisperse emulsion or monodisperse emulsion. The silver halide grains for use in the present invention is preferably monodispersion for the purpose of accelerating the development progress. A coefficient of variation in the grain size of each silver halide grain is preferably 0.3 or less (more preferably 0.3 to 0.05) and more preferably 0.25 or less (more preferably 0.25 to 0.05). The coefficient of variation so-called here is expressed by the ratio (s/d) of the value (s) of statistical standard deviation to the average grain size (d).

The silver halide photographic emulsions that can be used in the present invention may be prepared, for example, by the methods described in Research Disclosure (hereinafter abbreviated to as RD) No. 17643 (December 1978), pp. 22–23, "I. Emulsion preparation and types", and ibid. No. 18716 (November 1979), p. 648, and ibid. No. 307105 (November, 1989), pp. 863–865; the methods described by P. Glafkides, in Chemie et Phisique Photographique, Paul Montel (1967), by G. F. Duffin, in Photographic Emulsion Chemistry, Focal Press (1966), and by V. L. Zelikman et al., in Making and Coating of Photographic Emulsion, Focal Press (1964).

Monodispersed emulsions described in U.S. Pat. Nos. 3,574,628, and 3,655,394, and U.K. Patent No. 1,413,748 are also preferable.

Tabular grains having an aspect ratio of about 3 or more can also be used in the present invention. Tabular grains may be prepared easily, according to the methods described by Gutoff, in Photographic Science and Engineering, Vol. 14, pp.248–257 (1970); U.S. Pat. No. 4,434,226, No. 4,414,310, No. 4,433,048, and No. 4,439,520, and U.K. Patent No. 2,112,157.

As to the crystal structure, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion may be any one of a surface latent image-type that forms a latent image primarily on the grain surface, an internal latent image-type that forms a latent image inside the grain, and another type of emulsion that forms a latent image both on the surface and inside the grain; but it must be a negative type emulsion in any case. Among the internal latent image type emulsions, an emulsion of a core/shell type internal latent image type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development process.

As the silver halide emulsion, generally, those provided with physical ripening, chemical ripening, and spectral sensitization are used. Additives to be used in these steps are described in RD Nos. 17643, 18716, and 307105. Their relevant parts are listed in a table described later.

In the light-sensitive material of the present invention, two or more types of emulsions differing in at least one feature among the grain size, the distribution of grain size, halogen composition, the shape of the grain, and the sensitivity of the light-sensitive silver halide emulsion, may be mixed and used in one layer.

The amount of silver to be applied in the silver halide color photographic light-sensitive material of the present invention is preferably 6.0 g/m$^2$ or less, more preferably 4.5 g/m$^2$ or less, and particularly preferably 2.0 g/m$^2$ or less. Further, the amount of silver to be applied is generally 0.01 g/m$^2$ or more, preferably 0.02 g/m$^2$ or more, and more preferably 0.5 g/m$^2$ or more.

In the present invention, a 1-aryl-5-mercaptotetrazole compound, in an amount of preferably $1.0\times10^{-5}$ to $5.0\times10^{-2}$ mol, and more preferably $1.0\times10^{-4}$ to $1.0\times10^{-2}$ mol, per one mol of silver halide, is added to any one layer, preferably to a silver halide emulsion layer, in photographic structural layers composed of the light-sensitive silver halide emulsion layers and non-light-sensitive hydrophilic colloidal layers (intermediate layers and protective layers) disposed on the support. The addition of this compound in an amount falling in the above range further reduces contamination to the surface of a processed color photograph after continuous processing.

As the 1-aryl-5-mercaptotetrazole compound, preferable are those in which the aryl group at the 1-position is an unsubstituted or substituted phenyl group. Preferable specific examples of the substituent include an acylamino group (e.g., an acetylamino group and —$NHCOC_5H_{11}$(n)), a ureido group (e.g., a methylureido group), an alkoxy group (e.g., a methoxy group), a carboxylic acid group, an amino group, and a sulfamoyl group. A plurality of groups (e.g. two to three groups) selected from these groups may be bonded with the phenyl group. Also, the position of the substituent is preferably the meta or para position.

Specific examples of the compound include 1-(m-methylureidophenyl)-5-mercaptotetrazole and 1-(m-acetylaminophenyl)-5-mercaptotetrazole.

The photographic additives that can be used or can be used in combination in the present invention are described in the following Research Disclosures (RD), whose particular parts are given below in a table.

| Kind of Additive | RD 17643 | RD 18716 | RD 307105 |
|---|---|---|---|
| 1) Chemical sensitizers | p.23 | p.648 (right column) | p.866 |
| 2) Sensitivity-enhancing agents | | p.648 (right column) | |
| 3) Spectral sensitizers and Supersensitizers | pp.23–24 | pp.648 (right column)–649 (right column) | pp.866–868 |
| 4) Brightening agents | p.24 | pp.647 (right column) | p.868 |
| 5) Light absorbers, Filter dyes, and UV Absorbers | pp.25–26 | pp.649 (right column)–650 (left column) | p.873 |
| 6) Binders | p.26 | p.651 (left column) | pp.873–874 |
| 7) Plasticizers and Lubricants | p.27 | p.650 (right column) | p.876 |
| 8) Coating aids and Surfactants | pp.26–27 | p.650 (right column) | pp.875–876 |
| 9) Antistatic agents | p.27 | p.650 (right column) | pp.876–877 |
| 10) Matting agents | | | pp.878–879 |

In the silver halide color photographic light-sensitive material of the present invention, the following dye-forming couplers are particularly preferably used, though various dye-forming couplers can be used:

Yellow couplers: couplers represented by the formula (I) or (II) in EP502,424A; couplers represented by the formula (1) or (2) in EP513,496A (particularly, Y-28 on page 18); couplers represented by the formula (I) in claim 1 in JP-A-5-307248; couplers represented by the formula (I) in U.S. Pat. No. 5,066,576, column 1, line 45 to line 55; couplers represented by the formula (I) in JP-A-4-274425, Paragraph 0008; couplers described in claim 1 in EP498, 381A1, page 40 (particularly, D-35 on page 18); couplers represented by the formula (Y) in EP447,969A1, page 4

(particularly Y-1 (page 17) and Y-54 (page 41)); and couplers represented by one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A-4-73 and -75 (page 139) in EP456,257; M-4, -6 (page 26) and M-7 (page 27) in EP486,965; M-45 in JP-A-6-43611, Paragraph 0024; M-1 in JP-A-5-204106, Paragraph 0036; M-22 in JP-A-4-362631, Paragraph 0237.

Cyan couplers: CX-1, 3, 4, 5, 11, 12, 14 and 15 (page 14 to page 16) in JP-A-4-204843; C-7, 10 (page 35), 34, 35 (page 37), (1-1), (1-17) (page 42 to page 43) in JP-A-4-43345; and couplers represented by the formula (Ia) or (Ib) in claim 1 in JP-A-6-67385.

Polymer couplers: P-1 and P-5 (page 11) in JP-A-2-44345.

Sound track-forming infrared couplers: couplers described in JP-A-63-143546 and the publications referred to therein.

As couplers that form a color dye having a suitable diffusive property, those described in U.S. Pat. No. 4,366,237, GB 2,125,570, EP 96,873B, and DE 3,234,533 are preferable.

As couplers for compensating unnecessary absorption of color dye, yellow-colored cyan couplers represented by the formula (CI), (CII), (CIII) or (CIV) described on page 5 in EP456,257A1 (particularly YC-86, on page 84), yellow-colored magenta couplers ExM-7 (page 202), EX-1 (page 249) and Ex-7 (page 251) described in the same EP publication, magenta-colored cyan couplers CC-9 (column 8) and CC-13 (column 10) described in U.S. Pat. No. 4,833,069, and colorless masking couplers represented by the formula [C-1] described in claim 1 in WO92/11575 (particularly, the exemplified compounds on page 36 to page 45) and (2) (on column 8) of U.S. Pat. No. 4,837,136, are preferable.

Examples of the compound (including a dye-forming coupler) which reacts with an oxidized product of a developing agent to release a photographically useful compound residue, includes the followings:

Development inhibitor releasing compounds: compounds represented by the formula (I), (II), (III) or (IV) described in EP 378,236A1, page 11 (particularly T-101 (page 30), T-104 (page 31), T-113 (page 36), T-131 (page 45), T-144 (page 51) and T-158 (page 58)), compounds represented by the formula (I) in EP 436,938A2, page 7 (particularly, D-49 (page 51)), compounds represented by the formula (1) in JP-A-5-307248 (particularly, (23) in Paragraph 0027)) and compounds represented by the formula (I), (II) or (III) in EP 440,195A2, page 5 to page 6 (particularly, 1-(1) on page 29)).

Bleaching-accelerator-releasing compounds: compounds represented by the formula (I) or (I') described in EP 310,125A2, page 5 (particularly (60) and (61) on page 61) and compounds represented by the formula (I) in claim 1 in JP-A-6-59411 (particularly, (7) in Paragraph 0022).

Ligand-releasing compounds: compounds represented by LIG-X described in claim 1 in U.S. Pat. No. 4,555,478 (particularly, compounds described in column 12, lines 21 to 41).

Leuco dye-releasing compounds: compounds 1 to 6 in U.S. Pat. No. 4,749,641, columns 3 to 8.

Fluorescent dye-releasing compounds: compounds represented by COUP-DYE in claim 1 in U.S. Pat. No. 4,774,181 (particularly compounds 1 to 11 in columns 7 to 10).

Compounds, which release a development accelerator or fogging agent: compounds represented by the formula (1), (2) or (3) in U.S. Pat. No. 4,656,123, column 3 (particularly, (1-22) in column 25) and ExZK-2 in EP 450,637A2, page 75, line 36 to line 38.

Compounds which release a group that becomes a dye only after being spilt-off: compounds represented by the formula (I) in claim 1 in U.S. Pat. No. 4,857,447 (particularly, Y-1 to Y-19 in columns 25 to 36).

As additives other than the dye-forming coupler, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272;

Latex for impregnation of oil-soluble organic compound: latex described in U.S. Pat. No. 4,199,363;

Scavengers for an oxidized product of a developing agent: compounds represented by the formula (I) in U.S. Pat. No. 4,978,606, column 2, line 54 to line 62 (particularly 1-(1), (2), (6), (12) (columns 4 to 5)) and compounds represented by the formula in U.S. Pat. No. 4,923,787, column 2, line 5 to line 10 (particularly Compound 1 (column 3);

Stain preventive agents: compounds represented by one of the formulae (I) to (III) in EP 298321A, page 4, line 30 to line 33 (particularly, I-47, 72, III-1, 27 (page 24 to page 48));

Anti-fading agents: A-6, 7, 20, 21, 23, 24, 25, 26, 30, 37, 40, 42, 48, 63, 90, 92, 94 and 164 (page 69 to page 118) in EP 298321A, and II-1 to III-23 in U.S. Pat. No. 5,122,444, columns 25 to 38 (particularly, III-10), I-1 to III-4 in EP 471347A, page 8 to page 12 (particularly, II-2), and A-1 to 48 in U.S. Pat. No. 5,139,931, columns 32 to 40 (particularly A-39 and 42);

Materials for reducing the amount to be used of a color development-enhancing agent or color contamination preventive agent: I-1 to II-15 in EP 411324A, page 5 to page 24 (particularly, I-46);

Formalin scavengers: SCV-1 to 28 in EP 477932A, page 24 to page 29 (particularly SCV-8);

Hardener: H-1, 4, 6, 8 and 14 in JP-A-1-214845 in page 17, compounds (H-1 to H-54) represented by one of the formulae (VII) to (XII) in U.S. Pat. No. 4,618,573, columns 13 to 23, compounds (H-1 to 76) represented by the formula (6) in JP-A-2-214852, page 8, lower right (particularly, H-14), and compounds described in claim 1 in U.S. Pat. No. 3,325,287;

Development-inhibitor precursors: P-24, 37, 39 (page 6 to page 7) in JP-A-62-168139 and compounds described in claim 1 of U.S. Pat. No. 5,019,492 (particularly 28 to 29 in column 7);

Antiseptics and mildew-proofing agents: I-1 to III-43 in U.S. Pat. No. 4,923,790, columns 3 to 15 (particularly II-1, 9, 10 and 18 and III-25), Stabilizers and antifoggants: I-1 to (14) in U.S. Pat. No. 4,923,793, columns 6 to 16 (particularly, I-1, 60, (2) and (13), and compounds 1 to 65 in U.S. Pat. No. 4,952,483, columns 25 to 32 (particularly, 36);

Chemical sensitizers: triphenylphosphine selenide and compound 50 in JP-A-5-40324;

Dyes that can be used in combination with: a-1 to b-20 on page 15 to page 18 (particularly, a-1, 12, 18, 27, 35, 36, b-5) and compounds V-1 to 23 on pages 27 to 29, (particularly, V-1) in JP-A-3-156450, F-1-1 to F-II-43 in EP 445627A, page 33 to page 55 (particularly F-1-11 and F-II-8), III-1 to 36 in EP 457153A, page 17 to page 28 (particularly III-1 and 3), microcrystal dispersions of Dye-1 to 124 in WO88/04794, 8 to 26, compounds 1 to 22 in EP319999A, page 6 to page 11 (particularly, compound 1), compounds D-1 to 87 (page 3 to page 28) represented by one of the formulae (1) to (3) in EP 519306A, compounds 1 to 22 (columns 3 to 10) represented by the formula (I) in U.S. Pat. No. 4,268,622, compounds (1) to (31) (columns 2 to 9) represented by the formula (I) in U.S. Pat. No. 4,923,788;

UV absorbers: compounds (18b) to (18r) and 101 to 427 (page 6 to page 9) represented by the formula (1) in JP-A-46-3335, compounds (3) to (66) (page 10 to page 44) represented by the formula (I), compounds HBT-1 to HBT-10 (page 14) represented by the formula (III) in EP 520938A and compounds (1) to (31) (columns 2 to 9) represented by the formula (1) in EP 521823.

The silver halide color photographic light-sensitive material of the present invention may advantageously contain a fluorine-containing compound in a layer remotest from the support on the side having emulsion layers or a layer remotest from the support on the side having no emulsion layer, or in both the layers. In particular, it is preferred that the compounds described in Japanese Patent application No. 2001-308855 be used.

In the silver halide color photographic light-sensitive material of the present invention, the sum of the film thicknesses of all hydrophilic colloidal layers on the side provided with the emulsion layers is preferably 28 μm or less, more preferably 23 μm or less, still more preferably 18 μm or less, and particularly preferably 16 μm or less.

Further, the sum of the film thicknesses is generally 0.1 μm or more, preferably 1 μm or more, and more preferably 5 μm or more.

The film swelling rate $T_{1/2}$ is preferably 60 seconds or less, and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The term "film thickness" means a film thickness measured under controlled humid conditions of 25° C. and a relative humidity of 55% (2 days). $T_{1/2}$ can be measured using a swellometer of the type described by A. Green et al. in Photogr. Sci. Eng, Vol. 19, 2, page 124 to page 129. $T_{1/2}$ can be regulated by adding a hardener to a gelatin used as a binder, or by changing aging conditions after coating.

The rate of swelling is preferably 180 to 280%, and more preferably 200 to 250%.

Here, the term "rate of swelling" means a standard showing the magnitude of equilibrium swelling when the silver halide photographic light-sensitive material of the present invention is immersed in 35° C. distilled water to swell the material, and it is given by the following equation:

Rate of swelling (unit: %)=Total film thickness when swelled/Total film thickness when dried×100.

The above rate of swelling can be made to fall in the above range by adjusting the amount of a gelatin hardener to be added.

The support will be hereinafter explained.

In the present invention, as the support, a transparent support is preferable, and a plastic film support is more preferable.

Examples of the plastic film support include films, for example, of a polyethylene terephthalate, a polyethylene naphthalate, a cellulose triacetate, a cellulose acetate butylate, a cellulose acetate propionate, a polycarbonate, a polystyrene, or a polyethylene.

Among these films, polyethylene terephthalate films are preferable and biaxially oriented (stretched) and thermally fixed polyethylene terephthalate films are particularly preferable in view of stability, toughness and the like.

The thickness of the support is generally 15 to 500 μm, preferably 40 to 200 μm in view of ease of handling and usability for general purposes, and most preferably 85 to 150 μm, though no particular limitation is imposed on the thickness of the above support.

The transmission type support means those through which preferably 90% or more visible light transmits, and the support may contain silicon, alumina sol, chrome salt or zirconium salt which are made into a dye to the extent that it does not substantially inhibit the transmission of light.

The following surface treatment is generally carried out on the surface of the plastic film support, to bond light-sensitive layers firmly with the surface. The surface on the side where an antistatic layer (a backing layer) is formed is generally subjected to a surface treatment in the similar manner. Specifically, there are the following two methods:

(1) A method, in which a surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment, or ozone oxygen treatment, is carried out, and then a photographic emulsion (a coating solution for formation of a light-sensitive layer) is directly applied, to obtain adhesive force; and (2) A method, in which after the above surface treatment is once carried out, an undercoating layer is formed, and a photographic emulsion layer is applied onto the undercoating layer.

Among these methods, the method (2) is more effective and hence widely used. These surface treatments each are assumed to have the effects of: forming a polar group in some degree on the surface of the support, which is originally hydrophobic, removing a thin layer that gives an adverse effect on the adhesion of the surface, and increasing the crosslinking density of the surface, thereby increasing the adhesive force. As a result, it is assumed that, for example, the affinity of components contained in a solution of the undercoating layer to the polar group is increased and the fastness of the bonded surface is increased, thereby improving adhesion between the undercoating layer and the surface of the support.

It is preferable that a non-light-sensitive layer containing conductive metal oxide particles be formed, on the surface of the above plastic film support on the side provided with no light-sensitive layer.

As the binder for the above non-light-sensitive layer, an acrylic resin, vinyl resin, polyurethane resin or polyester resin is preferably used. The non-light-sensitive layer for use in the present invention is preferably film-hardened. As the hardener, an aziridine-series, triazine-series, vinylsulfone-series, aldehyde-series, cyanoacrylate-series, peptide-series, epoxy-series, melamine-series compound or the like is used. Among these, a melamine-series compound is particularly preferable in view of fixing the conductive metal oxide particles firmly.

Examples of materials to be used for the conductive metal oxide particles may include ZnO, $TiO_2$, $SnO_2$, $Al_2O_3$, $In_2O_3$, MgO, BaO, $MoO_3$ and $V_2O_5$, composite oxides of these oxides, and metal oxides obtained by adding a different type of atom to each of these metal oxides.

As the metal oxide, $SnO_2$, ZnO, $Al_2O_3$, $TiO_2$, $In_2O_3$, MgO and $V_2O_5$ are preferable, $SnO_2$, ZnO, $In_2O_3$, $TiO_2$ and $V_2O_5$ are more preferable and $SnO_2$ and $V_2O_5$ are particularly preferable. Examples of the metal oxide containing a small amount of a different type of atom may include those obtained by doping each of these metal oxides with generally 0.01 to 30 mol % (preferably 0.1 to 10 mol %) of a different element, specifically, by doping ZnO with Al or In, $TiO_2$ with Nb or Ta, $In_2O_3$ with Sn, and $SnO_2$ with Sb, Nb or a halogen atom. When the addition amount of the different type of element is too small, only insufficient conductivity can be imparted to the oxide or the composite oxide, whereas when the addition amount is too large, the blackening of the particle is increased, leading to the formation of a blackish antistatic layer. This shows that the oxides containing a different type of element in the amount out of the above range are unsuitable for the light-sensitive material. Therefore, as materials of the conductive metal oxide particle, metal oxides or composite metal oxides containing a small amount of a different type of element are preferable. Those having an oxygen defect in a crystal structure are also preferable.

The conductive metal oxide particles generally have a ratio by volume of 50% or less to the total non-light-sensitive layers. A preferable ratio is 3 to 30%. The amount of the conductive metal oxide particles to be applied preferably follows the conditions described in JP-A-10-62905.

When the volume ratio is too large, the surface of a processed color photograph is easily contaminated, whereas when the ratio is too small, the antistatic function is insufficiently performed.

It is preferable that the particle diameter of the conductive metal oxide particle be as smaller as possible to decrease light scattering. However, it must be determined based on the ratio of the refractive index of the particle to that of the binder as a parameter, and it can be determined using the Mie's theory. The average particle diameter is generally 0.001 to 0.5 $\mu$m, and preferably 0.003 to 0.2 $\mu$m. The average particle diameter so-called here is a value including not only a primary particle diameter but also a particle diameter of higher-order structure of the conductive metal oxide particles.

When the fine particle of the aforementioned metal oxide is added to a coating solution for forming an antistatic layer, it may be added as it is and dispersed. It is preferable to add the fine particle in the form of a dispersion solution in which the fine particle is dispersed in a solvent (including a dispersant and a binder according to the need) such as water.

The non-light-sensitive layer preferably contains the above hardened product of the above binder and a hardener, which product functions as a binder agent so as to disperse and support the conductive metal oxide particle. In the present invention, it is preferable that both of the binder and the hardener are soluble in water or are in the state of a water dispersion, such as an emulsion, in view of maintaining a better working environment and preventing air pollution. Also, the binder preferably has any group among methylol group, hydroxyl group, carboxyl group and glycidyl group, to enable a crosslinking reaction with the hardener. A hydroxyl group and a carboxyl group are preferable and a carboxyl group is particularly preferable. The content of the hydroxyl or carboxyl group in the binder is preferably 0.0001 to 1 equivalent/1 kg and particularly preferably 0.001 to 1 equivalent/1 kg.

Preferable resins to be used as the binder will be hereinafter explained.

Examples of acrylic resins may include homopolymers of any one monomer of acrylic acid, acrylates, such as alkyl acrylates; acrylamides; acrylonitriles, methacrylic acid; methacrylates, such as alkyl methacrylates; methacrylamides and methacrylonitriles, and copolymers obtained by polymerizing two or more of these monomers. Among these polymers or copolymers, homopolymers of any one monomer of acrylates, such as alkyl acrylates, and methacrylates, such as alkyl methacrylates, or copolymers obtained by polymerization of two or more of these monomers, are preferable. Examples of these homopolymers or copolymers may include homopolymers of any one monomer of acrylates and methacrylates having an alkyl group having 1 to 6 carbon atoms, or copolymers obtained by the polymerization of two or more of these monomers.

The above acrylic resin is preferably a polymer obtained by using the above composition as its major components and by partially using a monomer having any group of, for example, a methylol group, hydroxyl group, carboxyl group and glycidyl group so as to enable a crosslinking reaction with the hardener.

Preferable examples of the above vinyl resin include a polyvinyl alcohol, acid-denatured polyvinyl alcohol, polyvinyl formal, polyvinyl butyral, polyvinyl methyl ether, polyolefin, ethylene/butadiene copolymer, polyvinyl acetate, vinyl chloride/vinyl acetate copolymer, vinyl chloride/(meth)acrylate copolymer and ethylene/vinyl acetate-series copolymer (preferably an ethylene/vinyl acetate/(meth) acrylate copolymer). Among these, a polyvinyl alcohol, acid-denatured polyvinyl alcohol, polyvinyl formal, polyolefin, ethylene/butadiene copolymer and ethylene/vinyl acetate-series copolymer (preferably an ethylene/vinyl acetate/acrylate copolymer) are preferable.

In order to make the above vinyl resin be able to crosslink with the hardener, it is preferable that the polyvinyl alcohol, acid-denatured polyvinyl alcohol, polyvinyl formal, polyvinyl butyral, polyvinyl methyl ether and polyvinyl acetate are respectively formed as a polymer having a hydroxyl group by, for example, leaving a vinyl alcohol unit in the polymer; and that other polymers are respectively formed by partially using a monomer having any one group, for example, of a methylol group, hydroxyl group, carboxyl group and glycidyl group.

Examples of the above polyurethane resin may include polyurethanes derived from any one of a polyhydroxy compound (e.g., ethylene glycol, propylene glycol, glycerol and trimethylol propane), an aliphatic polyester-series polyol obtained by a reaction between a polyhydroxy compound and a polybasic acid; a polyether polyol (e.g., poly (oxypropylene ether)polyol, poly(oxyethylene-propylene ether)polyol), a polycarbonate-series polyol, and a polyethylene terephthalate polyol; or those derived from a polyisocyanate and a mixture of the above.

In the case of the above polyurethane resin, for instance, a hydroxyl group that is left unreacted after the reaction between the polyol and the polyisocyanate is completed, may be utilized as a functional group which can run a crosslinking reaction with the hardener.

As the above polyester resin, polymers obtained by a reaction between a polyhydroxy compound (e.g., ethylene glycol, propylene glycol, glycerol and trimethylolpropane) and a polybasic acid are generally used.

In the case of the above polyester resin, for instance, a hydroxyl group or a carboxyl group that is left unreacted after the reaction between the polyol and the polybasic acid is completed, may be utilized as a functional group which can run a crosslinking reaction with the hardener. Of course, a third component having a functional group such as a hydroxyl group may be added.

Among the above polymers, acrylic resins and polyurethane resins are preferable and acrylic resins are particularly preferable.

Examples of the melamine compound preferably used as the hardener include compounds having two or more (preferably three or more) methylol groups and/or alkoxymethyl groups in a melamine molecule, melamine resins which are condensation polymers of the above compounds., and melamine/urea resins.

Examples of initial condensation products of melamine and formalin include, though not limited to, dimethylolmelamine, trimethylolmelamine, tetramethylolmelamine, pentamethylolmelamine and hexamethylolmelamine. Specific examples of commercially available products of these compounds may include, though not limited to, Sumitex Resins M-3, MW, MK and MC (trade names, manufactured by Sumitomo Chemical Co., Ltd.).

Examples of the above condensation polymer may include, though not limited to, a hexamethylolmelamine resin, trimethylolmelamine resin, trimethyloltrimethoxymethylmelamine resin, and the like. Examples of commercially available products of the polymer may include, though not limited to, MA-1 and MA-204 (trade names, manufactured by Sumitomo Bakelite), BECKAMINE MA-S, BECKAMINE APM and BECKAMINE J-101 (trade names, manufactured by Dainippon Ink and Chemicals Inc.), Yuroid 344 (trade name, manufactured by Mitsui Toatsu Chemicals), Oshika Resin M31 and Oshika Resin PWP-8 (trade names, manufactured by Oshika Shinko Co., Ltd.), and the like.

As the melamine compound, it is preferable that the functional group equivalence given by a value obtained by dividing its molecular mass by the number of functional groups in one molecule be 50 or more and 300 or less. Here, the functional group indicates a methylol group and/or an alkoxymethyl group. If this value is too large, only small cured density is obtained and hence high mechanical strength is not obtained in some cases, however, if the amount of the melamine compound is increased, the coatability is reduced. When the cured density is small, scratches tend to be caused. Also, if the level of curing is low, the force supporting the conductive metal oxide is also reduced. When the functional group equivalence is too small, the cured density is increased but the transparency is impaired and even if the amount of the melamine compound is reduced, the condition is not bettered in some cases.

The amount of an aqueous melamine compound to be added is generally 0.1 to 100 mass %, and preferably 10 to 90 mass %, to the aforementioned polymer.

A matt agent, surfactant, lubricant, and the like may further be used in the antistatic layer, according to the need.

Examples of the matt agent include oxides, such as silicon oxide, aluminum oxide, and magnesium oxide, having a particle diameter of 0.001 to 10 $\mu$m, and polymers and copolymers, such as a poly(methyl methacrylate) and polystyrene.

Given as examples of the surfactant are known surfactants, such as anionic surfactants, cationic surfactants, amphoteric surfactants, and nonionic surfactants.

Examples of the lubricant may include phosphates of higher alcohols having 8 to 22 carbon atoms or their amino salts; palmitic acid, stearic acid and behenic acid, and their esters; silicone-series compounds, and the like.

The thickness of the aforementioned antistatic layer is preferably 0.01 to 1 $\mu$m, and more preferably 0.01 to 0.2 $\mu$m. When the thickness is too thin, coating nonuniformity tends to be caused on the resultant product since it is hard to apply a coating material uniformly. On the other hand, when the thickness is too thick, inferior antistatic ability and resistance to scratching can be caused sometimes.

It is preferable to dispose a surface layer on the above antistatic layer. The surface layer is provided primarily to improve lubricity and resistance to scratching, as well as to aid the ability to prevent the conductive metal oxide particles of the antistatic layer from desorbing.

Examples of materials for the above surface layer include (1) waxes, resins and rubber-like products comprising homopolymers or copolymers of 1-olefin-series unsaturated hydrocarbons, such as ethylene, propylene, 1-butene and 4-methyl-1-pentene (e.g., a polyethylene, polypropylene, poly-1-butene, poly-4-methyl-1-pentene, ethylene/propylene copolymer, ethylene/1-butene copolymer and propylene/1-butene copolymer), (2) rubber-like copolymers of two or more types of the above 1-olefin and a conjugated or non-conjugated diene (e.g., an ethylene/propylene/ethylidene norbornane copolymer, ethylene/propylene/1,5-hexadiene copolymer and isobutene/isoprene copolymer), (3) copolymers of a 1-olefin and a conjugated or non-conjugated diene (e.g., an ethylene/butadiene copolymer and ethylene/ethylidene norbornane copolymer), (4) copolymers of a 1-olefin, particularly ethylene, and a vinyl acetate, and completely or partly saponified products of these copolymers, and (5) graft polymers obtained by grafting the above conjugated or non-conjugated diene or vinyl acetate on a homopolymer or copolymer of a 1-olefin, and completely or partly saponified products of these graft polymers. However, the materials for the surface layer are not limited to these compounds. The aforementioned compounds are described in JP-B-5-41656 ("JP-B" means examined Japanese patent publication).

Among these compounds, those which are polyolefins and having a carboxyl group and/or a carboxylate group are preferable. These polyolefins are generally used in the form of an aqueous solution or a water dispersion solution.

An aqueous methyl cellulose of which the degree of methyl group substitution is 2.5 or less may be added in the surface layer, and the amount of the methyl cellulose to be added is preferably 0.1 to 40 mass % to the total binding agents forming the surface layer. The above aqueous methyl cellulose is described in JP-A-1-210947.

The above surface layer may be formed by applying a coating solution (water dispersion or aqueous solution) containing the aforementioned binder and the like, onto the antistatic layer, by using a generally well-known coating method, such as a dip coating method, air knife coating method, curtain coating method, wire bar coating method, gravure coating method or extrusion coating method.

The thickness of the above surface layer is preferably 0.01 to 1 $\mu$m, and more preferably 0.01 to 0.2 $\mu$m. When the thickness is too thin, coating nonuniformity of the product tends to be caused because it is hard to apply a coating material uniformly. When the thickness is too thick, inferior antistatic ability and resistance to scratching can be caused sometimes.

The pH of a coating in the silver halide color photographic light-sensitive material of the present invention is preferably 4.6 to 6.4, and more preferably 5.5 to 6.5. When the pH of the coating is too high, in a sample long under the lapse of time, a cyan image and a magenta image are greatly sensitized by irradiation with safelight. On the contrary, when the pH of the coating is too low, the density of a yellow image largely changes with a change in the time elapsing since the light-sensitive material is exposed until it is developed. Either of the cases poses practical problems.

The term "pH of coating" in the silver halide color photographic light-sensitive material of the present invention means the pH of all photographic layers obtained by applying each coating solution to the support, and it does not always coincides with the pH of the individual coating solution. The pH of coating can be measured by the following method as described in JP-A-61-245153. Specifically;

(1) 0.05 ml of pure water is added dropwise to the surface of a light-sensitive material on the side to which silver halide emulsions are applied. Then;

(2) after it is allowed to stand for 3 minutes, the pH of coating is measured using a surface pH measuring electrode (GS-165F, trade name, manufactured by Towa Denpa). The pH of coating can be adjusted using an acid (e.g., sulfuric acid or citric acid) or an alkali (e.g., sodium hydroxide or potassium oxide), if necessary.

The silver halide color photographic light-sensitive material of the present invention can secure safelight safety without lowering the sensitivity in wavelength regions that are normally required for light-sensitive materials. Further, it can be adapted to a simplified development processing step and is excellent in handling. Therefore, the silver halide color photographic light-sensitive material of the present invention is particularly suitable for a color photographic light-sensitive material for motion pictures.

The silver halide color photographic light-sensitive material of the present invention is easy to handle. Further, the silver halide color print material for motion picture according to the present invention has excellent safelight safety without deteriorating the sensitivity.

The present invention will be described in more detail based on examples given below, but the present invention is not meant to be limited by these examples.

EXAMPLES

Example 1

(Preparation of a Support)

A polyethylene terephthalate film support (thickness: 120 μm), provided with an undercoat on the side of the surface to which emulsions were to be applied, and also provided with an acrylic resin layer which contained the following conductive polymer (0.05 g/m$^2$) and tin oxide fine particles (0.20 g/m$^2$), on the side opposite to the surface to which emulsions were to be applied, was prepared.

Electro-conductive polymer

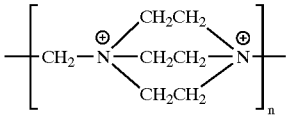

(Preparation of Silver Halide Emulsions)

Preparation of Blue-Sensitive Silver Halide Emulsions

Large-Size Emulsion (BO-01)

(Cube, Grain Size 0.71 μm, Grain Size Distribution 0.09, Halogen Composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $4\times10^{-7}$ mol/mol Ag. To this emulsion were added the sensitizing dyes (A') to (C') represented by the structural formulae which will be shown later, as follows.

Blue-sensitive sensitizing dye (A'): $3.5\times10^{-5}$ mol/mol Ag

Blue-sensitive sensitizing dye (B'): $1.9\times10^{-4}$ mol/mol Ag

Blue-sensitive sensitizing dye (C'): $1.8\times10^{-5}$ mol/mol Ag

Further, the emulsion was optimally gold-sulfur sensitized using chloroauric acid and triethylthiourea. Middle-size emulsion (BM-01)

(Cube, Grain Size 0.52 μm, Grain Size Distribution 0.09, Halogen Composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $6\times10^{-7}$ mol/mol Ag. To this emulsion were added the sensitizing dyes (A') to (C') represented by the structural formulae which will be shown later, as follows.

Blue-sensitive sensitizing dye (A'): $6.9\times10^{-5}$ mol/mol Ag

Blue-sensitive sensitizing dye (B'): $2.3\times10^{-4}$ mol/mol Ag

Blue-sensitive sensitizing dye (C'): $2.7\times10^{-5}$ mol/mol Ag

Further, the emulsion was optimally gold-sulfur sensitized using chloroauric acid and triethylthiourea.

Small-Size Emulsion (BU-01)

(Cube, Grain Size 0.31 μm, Grain Size Distribution 0.08, Halogen Composition Br/Cl=3/97)

This emulsion was prepared in the same manner as BM-01, except that, in the preparation of BM-01 emulsion, the grain formation temperature was lowered.

The sensitizing dyes (A') to (C') represented by the structural formulae which will be shown later, were added as follows.

Blue-sensitive sensitizing dye (A'): $8.5\times10^{-4}$ Mol/Mol Ag

Blue-sensitive sensitizing dye (B'): $4.1\times10^{-4}$ mol/mol Ag

Blue-sensitive sensitizing dye (C'): $3.7\times10^{-5}$ mol/mol Ag

Preparation of Red-Sensitive Silver Halide Emulsions

Large-Size Emulsion (RO-01)

(Cube, Grain Size 0.23 μm, Grain Size Distribution 0.11, Halogen Composition Br/Cl=25/75)

This emulsion was prepared by addition of an aqueous silver nitrate solution and an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (D') to (F') represented by the structural formulae which will be shown later, as follows, to effect spectral sensitization.

Red-sensitive sensitizing dye (D'): $4.5\times10^{-5}$ mol/mol Ag

Red-sensitive sensitizing dye (E'): $0.2\times10^{-5}$ mol/mol Ag

Red-sensitive sensitizing dye (F'): $0.1\times10^{-5}$ mol/mol Ag

Furthermore, this emulsion was optimally gold-sulfur sensitized with chloroauric acid and triethylthiourea, and thereafter Cpd-71 represented by the structural formula which will be shown later, was added in an amount of $9.0\times10^{-4}$ mol per mol of silver halide.

Middle-Size Emulsion (RM-01)

(Cube, Grain Size 0.174 μm, Grain Size Distribution 0.12, Halogen Composition Br/Cl=25/75)

This emulsion was prepared in the same manner as RO-01, except that, in the preparation of RO-01 emulsion, the grain formation temperature was lowered. The sensitizing dyes (D') to (F') represented by the structural formulae which will be shown later, were added as follows.

Red-sensitive sensitizing dye (D'): $7.0\times10^{-5}$ mol/mol Ag

Red-sensitive sensitizing dye (E'): $1.0\times10^{-5}$ mol/mol Ag

Red-sensitive sensitizing dye (F'): $0.4\times10^{-5}$ mol/mol Ag

Small-Size Emulsion (RU-01)

(Cube, Grain Size 0.121 μm, Grain Size Distribution 0.13, Halogen Composition Br/Cl=25/75)

This emulsion was prepared in the same manner as RO-01, except that, in the preparation of RO-01 emulsion, the grain formation temperature was lowered. The sensitizing dyes (D') to (F') represented by the structural formulae which will be shown later, were added as follows.

Red-sensitive sensitizing dye (D'): $8.9\times10^{-5}$ mol/mol Ag

Red-sensitive sensitizing dye (E'): $1.2\times10^{-5}$ mol/mol Ag

Red-sensitive sensitizing dye (F'): $0.5\times10^{-5}$ mol/mol Ag

Preparation of Green-Sensitive Silver Halide Emulsions

Large-Size Emulsion (GO-01)

(Cube, Grain Size 0.20 μm, Grain Size Distribution 0.11, Halogen Composition Br/Cl=3/97)

This emulsion was prepared by addition of an aqueous silver nitrate solution, an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (G') to (J') represented by the structural formulae which will be shown later, as follows, to effect spectral sensitization.

Green-sensitive sensitizing dye (G'): $2.8\times10^{-4}$ mol/mol Ag

Green-sensitive sensitizing dye (H'): $0.8\times10^{-4}$ mol/mol Ag

Green-sensitive sensitizing dye (I'): $1.2\times10^{-4}$ mol/mol Ag

Green-sensitive sensitizing dye (J'): $1.2\times10^{-4}$ mol/mol Ag

Further, the emulsion was optimally gold-sulfur sensitized using chloroauric acid and triethylthiourea.

Middle-Size Emulsion (GM-01)

(Cube, Grain Size 0.146 μm, Grain Size Distribution 0.12, Halogen Composition Br/Cl=3/97)

This emulsion was prepared in the same manner as GO-01, except that, in the preparation of GO-01 emulsion, the grain formation temperature was lowered. The sensitizing dyes (G') to (J') represented by the structural formulae which will be shown later, were added as follows.

Green-sensitive sensitizing dye (G'): $3.8\times10^{-4}$ mol/mol Ag

Green-sensitive sensitizing dye (H'): $1.3\times10^{-4}$ mol/mol Ag

Green-sensitive sensitizing dye (I'): $1.4\times10^{-4}$ mol/mol Ag

Green-sensitive sensitizing dye (J'): $1.2\times10^{-4}$ mol/mol Ag

Small-Size Emulsion (GU-01)

(Cube, Grain Size 0.102 μm, Grain Size Distribution 0.10, Halogen Composition Br/Cl=3/97)

This emulsion was prepared in the same manner as GO-01, except that, in the preparation of GO-01 emulsion, the grain formation temperature was lowered. The sensitizing dyes (G') to (J') represented by the structural formulae which will be shown later, were added as follows.

Green-sensitive sensitizing dye (G'): $5.1\times10^{-4}$ mol/mol Ag

Green-sensitive sensitizing dye (H'): $1.7\times10^{-4}$ mol/mol Ag

Green-sensitive sensitizing dye (I'): $1.9\times10^{-4}$ mol/mol Ag

Green-sensitive sensitizing dye (H'): $1.2\times10^{-4}$ mol/mol Ag

Sensitizing dye (A')

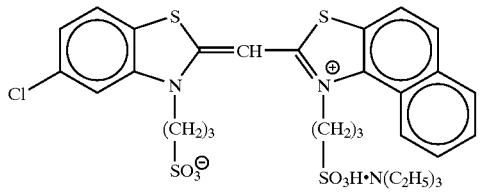

Snsitizing dye (B')

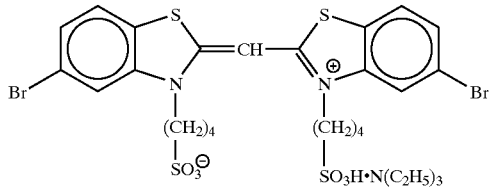

Sensitizing dye (C')

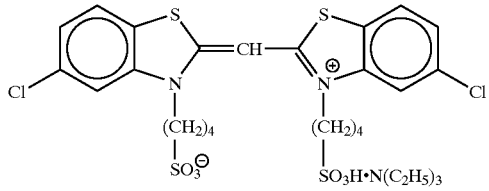

Sensitizing dye (D')

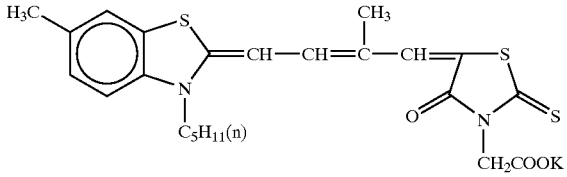

Sensitizing dye (E')

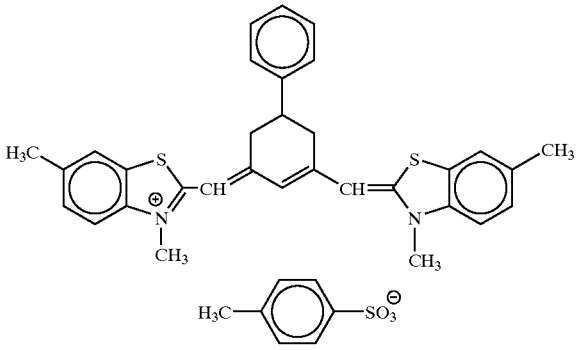

Sensitizing dye (F')

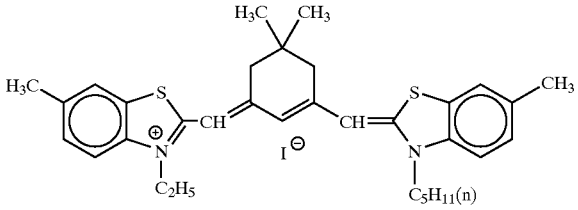

-continued

Sensitizing dye (G')

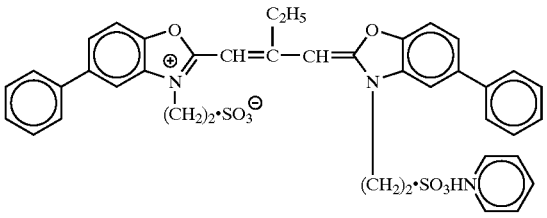

Sensitizing dye (H')

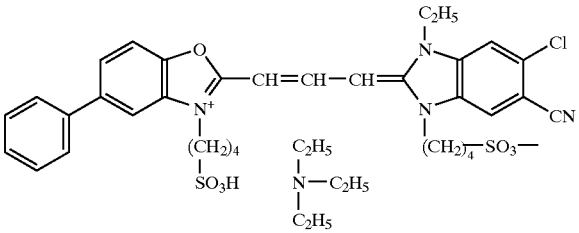

Sensitizing dye (I')

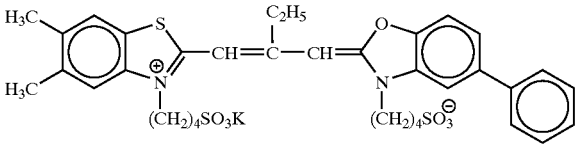

Sensitizing dye (J')

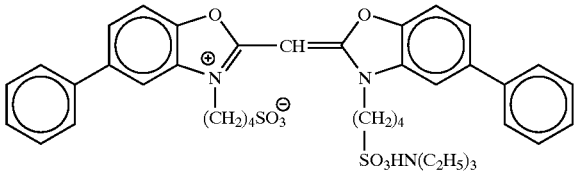

(Cpd-71)

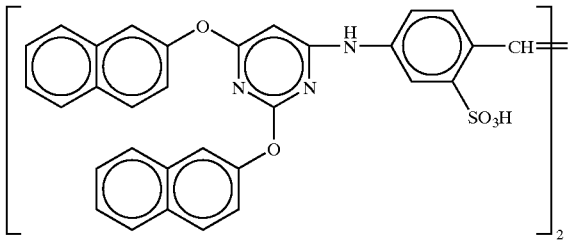

(Preparation of a Solid Fine-Particle Dispersion of a Dye)

A methanol wet cake of the compound (IV-1) was weighed such that the net amount of the compound was 240 g, and 48 g of the compound (V-12) as a dispersing aid was weighed. To the compounds was added water such that the total amount was 4000 g. The mixture was crushed at a discharge rate of 0.5 l/min and a peripheral velocity of 10 m/s for 2 hours by using "a flow system sand grinder mill (UVM-2)" (trade name, manufactured by AIMEX K.K.) filled with 1.7 l of zirconia beads (diameter: 0.5 mm). The thus-obtained dispersion was subjected to heat treatment at 90° C. for 10 hours (i.e. the dispersion was heated while stirring). Then, the dispersion was diluted such that the concentration of the compound was 3 mass %, and Compound (Pm-1) having the below shown structure was added in an amount of 3% in terms of mass ratio to the dye (this dispersion will be referred to as Dispersion A). The average particle size of this dispersion was 0.45 $\mu$m. Further, a dispersion, which contained 5 mass % of Compound (II-4), was prepared in the same manner as above (this will be referred to as Dispersion B).

Pm-1

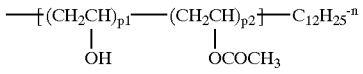

Degree of polymerization 300 p1 = 88 mol%
p2 = 12 mol%

(Preparation of Sample 101)

Each layer having the composition shown below was applied to the support by multilayer-coating, thereby producing a multilayer color photographic light-sensitive material as Sample 101.

Layer Constitution

The composition of each layer is shown below. The numerals show the amount (g/m$^2$) to be applied. As the amount of the silver halide emulsion, an amount converted into that of silver is shown. As a gelatin hardener, a sodium salt of 1-oxy-3,5-dichloro-s-triazine was used.

Support

Polyethylene terephthalate film

| | |
|---|---|
| First layer (halation preventive layer (non-light-sensitive hydrophilic colloid layer)) | |
| Gelatin | 1.02 |
| The above Dispersion A (in terms of coating amount of dye) | 0.09 |
| The above Dispersion B (in terms of coating amount of dye) | 0.03 |
| Second layer (blue light-sensitive silver halide emulsion layer) | |
| A mixture of silver chlorobromide emulsions BO-01, BM-01, and BU-01, mixed in a ratio of 3:1:6 (mol ratio of silver) | 0.54 |
| Gelatin | 2.71 |
| Yellow coupler (ExY') | 1.19 |
| (Cpd-41) | 0.0006 |
| (Cpd-42) | 0.01 |
| (Cpd-44) | 0.003 |
| (Cpd-45) | 0.012 |
| (Cpd-46) | 0.001 |
| (Cpd-54) | 0.08 |
| Solvent (Solv-21) | 0.26 |
| Third Layer (Color-Mixing Inhibiting Layer) | |
| Gelatin | 0.59 |
| (Cpd-49) | 0.02 |
| (Cpd-43) | 0.05 |
| (Cpd-53) | 0.005 |
| (Cpd-61) | 0.02 |
| (Cpd-62) | 0.07 |
| Solvent (Solv-21) | 0.06 |
| Solvent (Solv-23) | 0.04 |
| Solvent (Solv-24) | 0.002 |
| Fourth layer (red light-sensitive silver halide emulsion layer) | |
| A mixture of silver chlorobromide emulsions RO-01, RM-01, and RU-01, mixed in a ratio of 2:2:6 (mol ratio of silver) | 0.38 |
| Gelatin | 2.79 |
| Cyan coupler (ExC') | 0.78 |
| (Cpd-47) | 0.06 |
| (Cpd-48) | 0.06 |
| (Cpd-50) | 0.03 |
| (Cpd-52) | 0.03 |
| (Cpd-53) | 0.03 |
| (Cpd-57) | 0.05 |
| (Cpd-58) | 0.01 |

-continued

| | |
|---|---|
| Solvent (Solv-21) | 0.51 |
| Solvent (Solv-22) | 0.28 |
| Solvent (Solv-23) | 0.03 |
| Fifth Layer (Color-Mixing Inhibiting Layer) | |
| Gelatin | 0.56 |
| (Cpd-49) | 0.02 |
| (Cpd-43) | 0.05 |
| (Cpd-53) | 0.005 |
| (Cpd-64) | 0.005 |
| Solvent (Solv-21) | 0.06 |
| Solvent (Solv-23) | 0.04 |
| Solvent (Solv-24) | 0.002 |
| Sixth Layer (Green Light-Sensitive silver halide Emulsion Layer) | |
| A mixture of silver chlorobromide emulsions GO-01, GM-01, GU-01, mixed in a ratio of 1:3:6 (mol ratio of silver) | 0.50 |
| Gelatin | 1.55 |
| Magenta coupler (ExM') | 0.70 |
| (Cpd-49) | 0.012 |
| (Cpd-51) | 0.001 |
| (Cpd-52) | 0.02 |
| Solvent (Solv-21) | 0.13 |
| Seventh Layer (Protective Layer) | |
| Gelatin | 0.97 |
| Acrylic resin (av. particle diameter, 2 μm) | 0.002 |
| (Cpd-52) | 0.03 |
| (Cpd-55) | 0.005 |
| (Cpd-56) | 0.08 |

Herein, the compounds used are shown below.

E x Y'

(1)

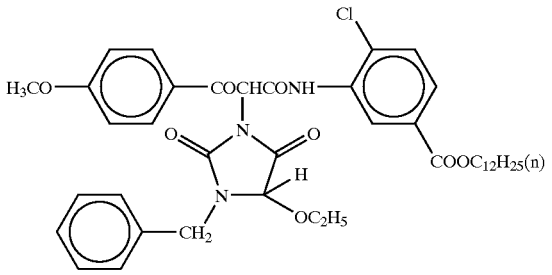

(2)

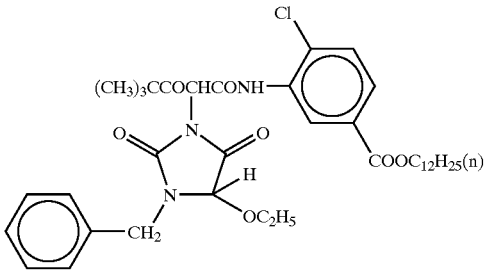

-continued (3)

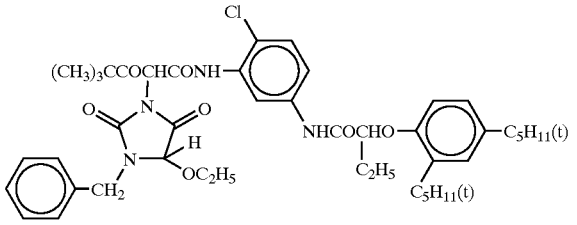

A mixture of (1), (2), and (3) in 80:10:10 (molar ratio)

E x C'

(1)

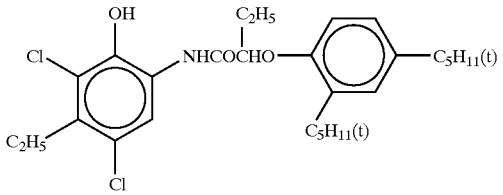

(2)

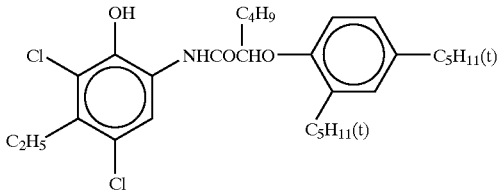

(3)

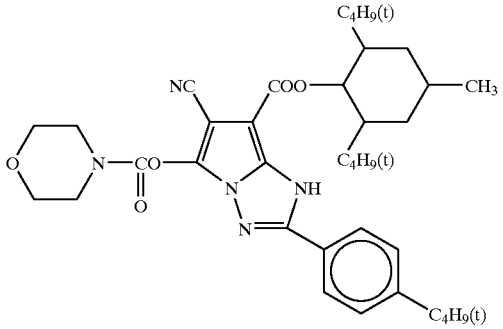

A mixture of (1), (2), and (3) in 40:40:20 (molar ratio)

E x M'

(1)

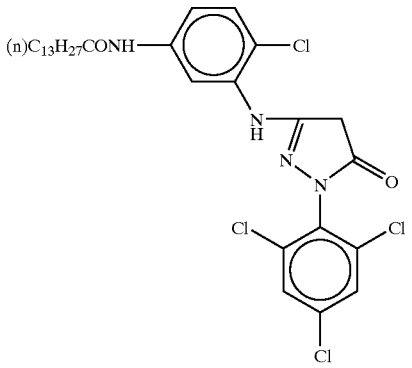

-continued
(2)
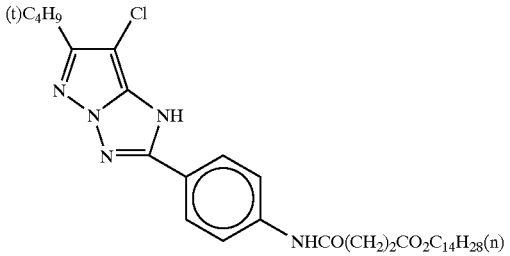
A mixture of (1) and (2) in 90:10 (molar ratio)
(Cpd-41)
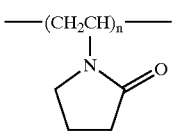
(Cpd-42)
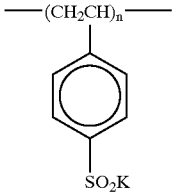
(Cpd-43)
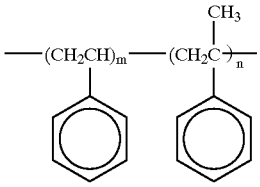
number-average
molecular mass 600
m/n = 10/90
(Cpd-44)
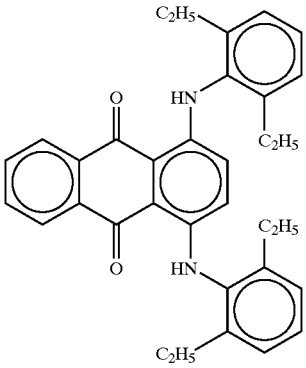
-continued
(Cpd-45)
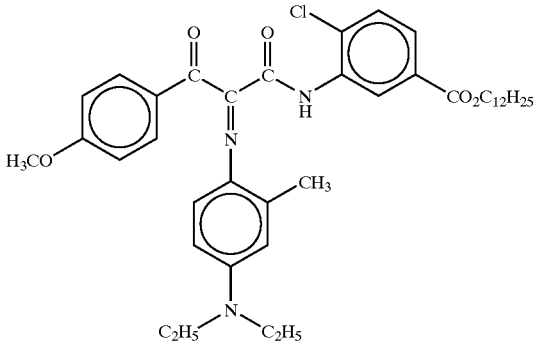
(Cpd-46)
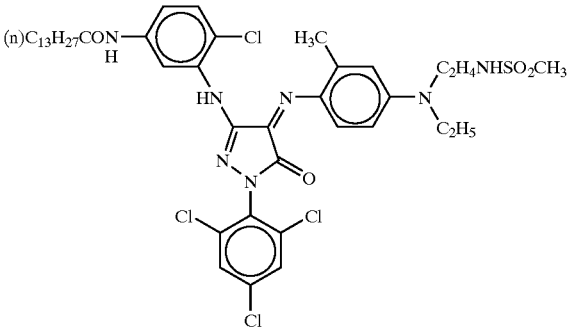
(Cpd-47)
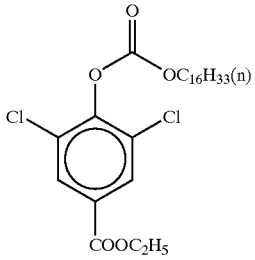
(Cpd-48)
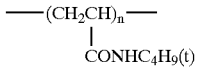
average molecular mass
about 60,000
(Cpd-49)
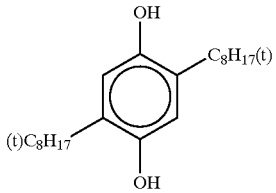
(Cpd-50)
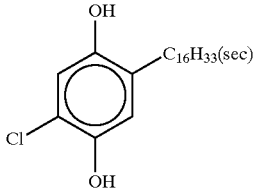
(Cpd-51)
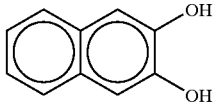

-continued (Cpd-52)

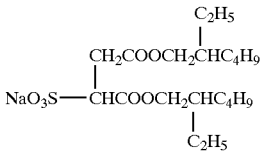

(Cpd-53)

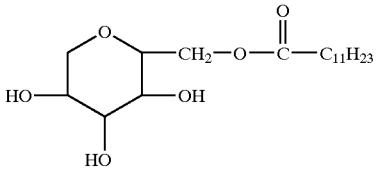

(Cpd-54)

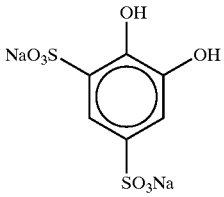

(Cpd-55)

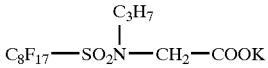

(Cpd-56)

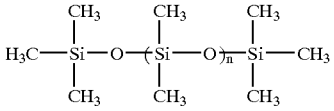

(Cpd-57)

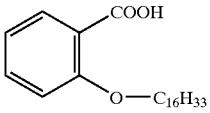

(Cpd-58)

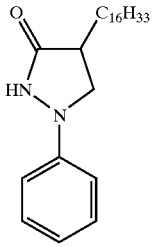

(Cpd-61)

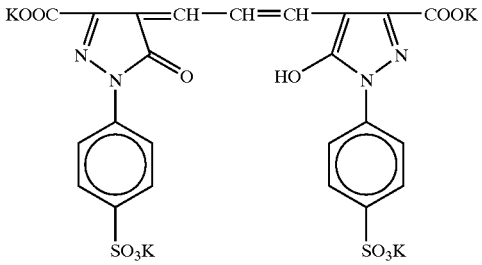

-continued (Cpd-62)

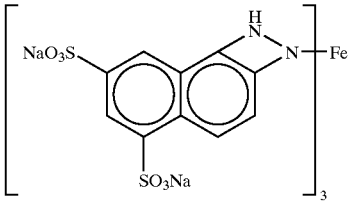

(Cpd-64)

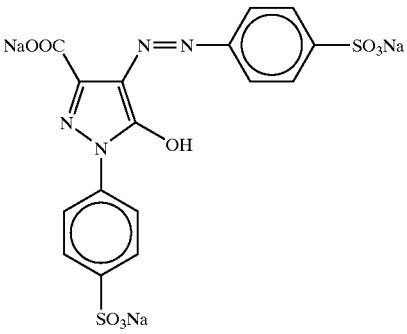

(Solv-21)

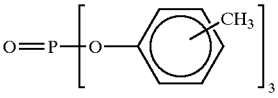

(Solv-22)

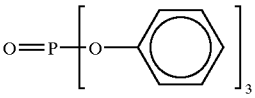

(Solv-23)

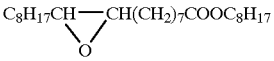

(Solv-24)

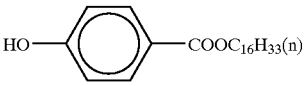

In the above manner, Sample 101 was prepared.

(Preparation of Samples 102 to 121)

Next, Samples 102 to 121, to which the compounds described below were added, were prepared. In this connection, the following compounds were added to the third and fifth layers with dividing the amounts in portions. The amount of each compound and the contents in each sample were shown in Table 1, along with the evaluation results.

(CC-1)

The same compound as the above Cpd-62
λ max = 710 nm
Half width at half maximum on the shorter wavelength side = 126 nm (L-1)

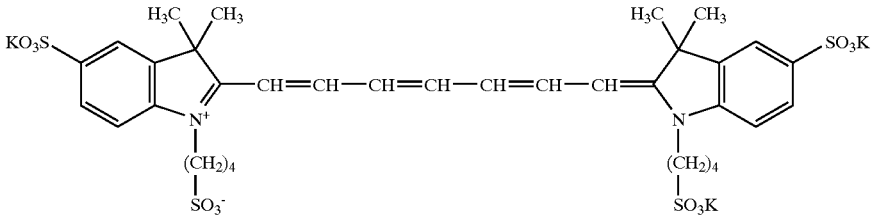

λ max = 766 nm
Half width at half maximum on the shorter wavelength side = 38 nm (L-2)

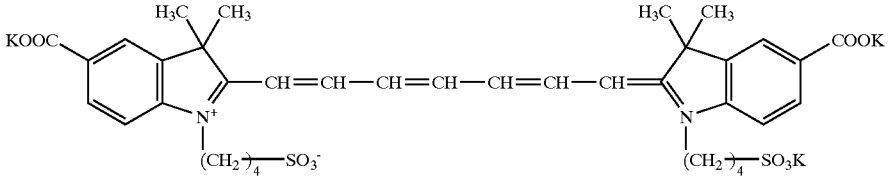

λ max = 762 nm
Half width at half maximum on the shorter wavelength side = 40 nm (L-3)

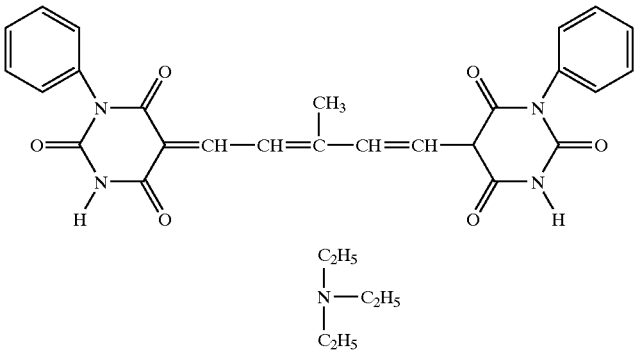

λ max = 744 nm
Half width at half maximum on the shorter wavelength side = 86 nm (S-1)

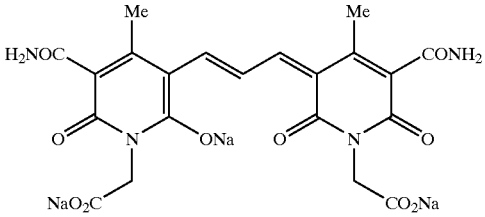

λ max = 589 nm
Half width at half maximum on the longer wavelength side = 23 nm (S-2)

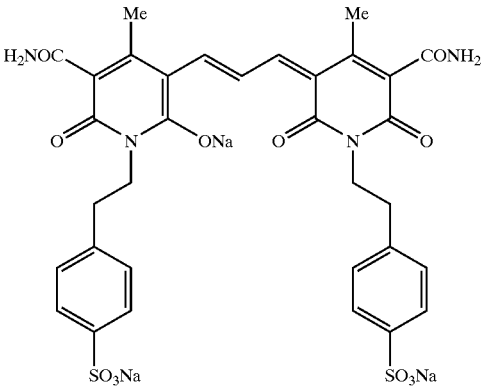

λ max = 589 nm
Half width at half maximum on the longer wavelength side = 24 nm

-continued (S-3)

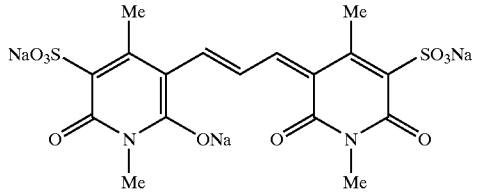

λ max = 588 nm
Half width at half maximum on the longer wavelength side = 22 nm (M-1)

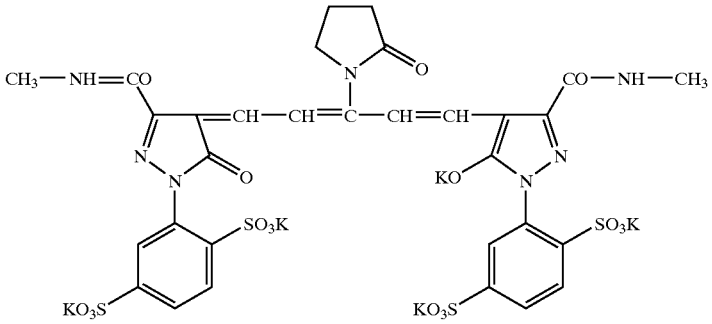

λ max = 700 nm
Half width at half maximum on the shorter wavelength side = 73 nm (M-2)

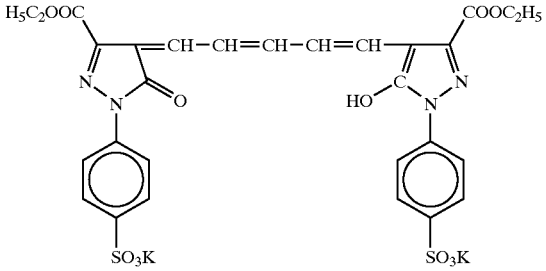

λ max = 664 nm
Half width at half maximum on the shorter wavelength side = 62 nm (Preparation of Processing Solutions)

A processing process, according to the ECP-2 process published from Eastman Kodak, as a standard method for processing a motion picture color positive film was utilized with the modification that the sound development step was excluded from the ECP-2 process. Then, for the purpose of preparing a development process condition in a running equilibrium state, all samples prepared as above were respectively exposed to such an image that about 30% of the amount of coated silver would be developed, and then each sample which had been exposed was subjected to continuous processing (running test) performed according to the above processing process, until the amount of the replenisher solution in the color developing bath became twice the tank volume.

ECP-2 Process (Excluding the Sound Developing Step)
<Step>

| Name of step | Process Temp. (° C.) | Process time (sec) | Replenisher amount (ml per 35 mm × 30.48 m) |
|---|---|---|---|
| 1. Pre-bath | 27 ± 1 | 10–20 | 400 |
| 2. Washing | 27 ± 1 | Jet water washing | — |
| 3. Developing | 39.0 ± 0.1 | 180 | 690 |
| 4. Stop | 27 ± 1 | 40 | 770 |
| 5. Washing | 27 ± 3 | 40 | 1200 |
| 6. First fixing | 27 ± 1 | 40 | 200 |
| 7. Washing | 27 ± 3 | 40 | 1200 |
| 8. Bleach acceleration | 27 ± 1 | 20 | 200 |
| 9. Bleaching | 27 ± 1 | 40 | 200 |
| 10. Washing | 27 ± 3 | 40 | 1200 |

-continued

| Name of step | Process Temp. (° C.) | Process time (sec) | Replenisher amount (ml per 35 mm × 30.48 m) |
|---|---|---|---|
| 11. Second fixing | 27 ± 1 | 40 | 200 |
| 12. Washing | 27 ± 3 | 60 | 1200 |
| 13. Rinsing | 27 ± 3 | 10 | 400 |
| 14. Drying | | | |

<Formulation of Process Solutions>
Composition per 1 liter is shown.

| Name of steps | Name of Chemicals | Tank solution | Replenisher solution |
|---|---|---|---|
| Pre-bath | VOLAX | 20 g | 20 g |
| | Sodium sulfate | 100 g | 100 g |
| | Sodium hydroxide | 1.0 g | 1.5 g |
| Developing | Kodak Anti-calcium No. 4 (trade name) | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stop | Sulfuric acid (7N) | 50 ml | 50 ml |
| Fixing (common to the first fixing and the second fixing) | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleach acceleration | Sodium hydrogen metasulfite | 3.3 g | 5.6 g |
| | Acetic acid | 5.0 ml | 7.0 ml |
| | PBA-1 (Kodak Persulfate Bleach Accelerator, trade name) | 3.3 g | 4.9 g |
| | EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogen-phosphate | 7.0 g | 10.0 g |
| | Phosphoric acid (85%) | 2.5 ml | 2.5 ml |
| Rinsing | Kodak Stabilizer Additive (trade name) | 0.14 ml | 0.17 ml |
| | Dearcide 702 (trade name) | 0.7 ml | 0.7 ml |

In the above, Dearcide 702 used in the rinsing step is a mildewproof agent.

(Samples and Evaluations)

After the above-mentioned Samples 101 to 121 were prepared, they were left to stand at room temperature for 2 weeks and then the following evaluation tests were carried out.

<Evaluation on the Sensitivity to Red Light>

For each sample, sensitometry exposure with red light was performed by using a sensitometer (FWH type, manufactured by Fuji Photo Film Co., Ltd., color temperature of light source 3200K) through an optical wedge, which varied in optical density in steps of 0.2 per 5 mm. The samples after completion of exposure were processed for color development with a processing solution after completion of the running test. The obtained processed samples were measured for Status A densities by X-rite 310 densitometer (trade name, manufactured by Xrite), and logarithmic values of the exposure amounts were plotted to the densities, to prepare a so-called sensitometry curve.

A logarithmic value of the exposure amount at a point that gives a density of 1.0 in this sensitometry sensitivity was obtained for each sample, and the value of each sample was deduced from the value of Sample 101 to obtain a sensitivity value for each sample. The results are shown in Table 1. Note that values with a positive sign show that the samples are more sensitive than Sample 101 and those with a negative sign shows that they are less sensitive than Sample 101. It can be said that the greater the value, the higher the sensitivity of the sample and the more preferable the sample is.

<Evaluation on the Sensitivity to Green Light>

Sensitometry evaluation with green light was performed under conditions similar to those described in the above. The processing of samples and the evaluation method for sensitivity were the same as those for sensitivity evaluation for red light. The results are shown in Table 1.

<Evaluation on the Sensitivity to Safelight>

The light from a low-pressure sodium lamp used as a light source was uniformly irradiated to the samples from the emulsion side for 10 minutes, and then the above-mentioned processing was performed, and the optical density of the cyan color image was measured by X-rite 310 densitometer. Under the conditions under which the optical density of Sample 101 became 0.40, other samples were also irradiated to obtain the optical densities of the cyan images, and these densities were evaluated as safelight sensitivity. The results are shown in Table 1. The smaller the value, the higher the safelight safety, and this indicates that the sample is easier to handle.

<Evaluation of Transmission Absorption Density Ratio>

Transmission absorption densities at 590 nm and 800 nm of each sample were measured using a spectrophotometer U3410 Type (trade name) manufactured by Hitachi Limited, and the ratio of the transmission absorption density AS at 590 nm and the transmission absorption density AI at 800 nm (AI/AS) are shown in Table 1. Note that, in Table 1, absorption densities at 590 nm that is a wavelength at which the low-pressure sodium lamp emits light are also described to show relevance with the above-mentioned safelight sensitivity.

TABLE 1

| | Compound having maximum absorption at 740 nm or more | | Compound having maximum absorption at 570 to 610 nm | | Compound having maximum absorption at 650 to less than 740 nm | | Transmission absorption density ratio (AI/AS) | Sensitivity | | Safelight safety | | |
|---|---|---|---|---|---|---|---|---|---|---|---|---|
| Sample No. | Kind | Amount (mg/m²) | Kind | Amount (mg/m²) | Kind | Amount (mg/m²) | | Green light | Red light | Absorption density (590 nm) | Sensitivity | Remarks |
| 101 | — | — | — | — | CC-1 | 68.0 | 0.91 | 0.00 | 0.00 | 0.71 | 0.40 | Comparative example |
| 102 | — | — | S-1 | 9.0 | CC-1 | 68.0 | 0.33 | −0.15 | −0.02 | 0.98 | 0.24 | Comparative example |

TABLE 1-continued

| Sample No. | Compound having maximum absorption at 740 nm or more Kind | Amount (mg/m²) | Compound having maximum absorption at 570 to 610 nm Kind | Amount (mg/m²) | Compound having maximum absorption at 650 to less than 740 nm Kind | Amount (mg/m²) | Transmission absorption density ratio (AI/AS) | Sensitivity Green light | Red light | Safelight safety Absorption density (590 nm) | Sensitivity | Remarks |
|---|---|---|---|---|---|---|---|---|---|---|---|---|
| 103 | — | — | S-1 | 9.0 | — | — | <0.1 | −0.02 | 0.54 | 0.84 | 0.55 | Comparative example |
| 104 | — | — | S-1 | 18.0 | — | — | <0.1 | −0.16 | 0.52 | 1.12 | 0.43 | Comparative example |
| 105 | — | — | S-1 | 9.0 | M-1 | 49.1 | <0.1 | −0.05 | 0.09 | 0.85 | 0.31 | Comparative example |
| 106 | — | — | — | — | M-1 | 49.1 | <0.1 | 0.02 | 0.10 | 0.65 | 0.44 | Comparative example |
| 107 | L-1 | 17.0 | — | — | — | — | 3.1 | 0.08 | 0.33 | 0.63 | 0.64 | Comparative example |
| 108 | L-1 | 17.0 | — | — | M-1 | 27.3 | 2.1 | 0.04 | 0.14 | 0.66 | 0.38 | Comparative example |
| 109 | L-1 | 17.0 | — | — | M-1 | 49.1 | 1.0 | 0.02 | 0.01 | 0.69 | 0.35 | Comparative example |
| 110 | L-1 | 17.0 | S-1 | 9.0 | — | — | 0.43 | −0.05 | 0.30 | 0.89 | 0.22 | This invention |
| 111 | L-1 | 17.0 | S-1 | 18.0 | — | — | 0.27 | −0.18 | 0.29 | 1.08 | 0.09 | This invention |
| 112 | L-1 | 25.5 | S-1 | 9.0 | — | — | 0.62 | −0.08 | 0.22 | 0.91 | 0.12 | This invention |
| 113 | L-1 | 8.5 | S-1 | 9.0 | — | — | 0.21 | −0.08 | 0.25 | 0.90 | 0.20 | This invention |
| 114 | L-1 | 17.0 | S-1 | 9.0 | M-1 | 27.3 | 0.39 | −0.08 | 0.15 | 0.93 | 0.04 | This invention |
| 115 | L-2 | 15.6 | S-1 | 9.0 | — | — | 0.44 | −0.04 | 0.27 | 0.89 | 0.24 | This invention |
| 116 | L-2 | 15.6 | S-1 | 9.0 | M-1 | 27.3 | 0.41 | −0.09 | 0.14 | 0.81 | 0.10 | This invention |
| 117 | L-3 | 11.7 | S-1 | 9.0 | M-1 | 27.3 | 0.46 | −0.10 | 0.17 | 0.92 | 0.14 | This invention |
| 118 | L-1 | 17.0 | S-2 | 10.9 | — | — | 0.65 | −0.01 | 0.35 | 0.86 | 0.19 | This invention |
| 119 | L-1 | 17.0 | S-3 | 8.1 | — | — | 0.62 | 0.01 | 0.33 | 0.87 | 0.15 | This invention |
| 120 | L-1 | 17.0 | S-3 | 8.1 | M-1 | 27.3 | 0.41 | −0.03 | 0.20 | 0.90 | 0.03 | This invention |
| 121 | L-1 | 17.0 | S-1 | 9.0 | M-2 | 29.0 | 0.36 | −0.10 | 0.12 | 0.91 | 0.08 | This invention |

<Evaluation Results>

As will be apparent from the results shown in Table 1, Samples 101 and 102, which employed a compound having an absorption waveform with a broad half width at half maximum, exhibited relatively high safelight safety but the sensitivity itself of each sample was decreased. In Samples 103 to 109, which were cases where a compound having a maximum absorption at 740 nm or more, a compound having a maximum absorption at 570 to 610 nm, and a compound having a maximum absorption at 650 to less than 740 nm were used singly or in combinations outside the present invention, the safelight safety was not improved. In contrast, Samples 110 to 121, which employed these compounds in combinations in accordance with the present invention, attained excellent sensitivity and safelight safety compatibly.

Furthermore, from the results shown in Table 1, it can be seen that the safelight safety and the absorption density at 590 nm were irrelevant to each other in the present invention. This indicates that the present invention operates based on a mechanism that is different from control of sensitivity by changing the absorption density at a certain wavelength region.

Moreover, among the combinations according to the present invention, cases where a compound having a maximum absorption at 650 to less than 740 nm was used in combination (Samples 114, 116, 117, 120 and 121), or cases where the ratio of transmission absorption densities at 590 nm and 800 nm (AI/AS) was 0.3 or more (Samples 110, 112, and 114 to 121), attained superior results.

Example 2

Samples 201 to 221 were prepared in the same manner as in Example 1, except that, in the ECP-2 processing process at the time of preparation of Samples 101 to 121 in Example 1, the Pre-bath step as a first step and the subsequent Washing step were omitted. The thus-obtained samples were subjected to the same tests as employed in Example 1. As a result, similar results to those in Example 1 were obtained; further, no unnecessary coloring (stain) due to failure of elution of coloring compounds from the light-sensitive material was observed, though such coloring had been predicted to occur due to omission of steps. Therefore, it can be seen that the color photographic light-sensitive material of the present invention can exhibit its performance even in a simplified processing step.

Example 3

Samples 301 to 321 were prepared in the same manner as Samples 101 to 121 in Example 1, except that Cpd-55 introduced into the seventh layer was changed to the compound (SF-1) shown below. These samples were subjected to the same tests as those in Example 1, and similar results to those in Example 1 were obtained.

(SF-1)

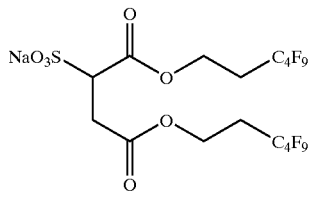

Having described our invention as related to the present embodiments, it is our intention that the invention not be limited by any of the details of the description, unless otherwise specified, but rather be construed broadly within its spirit and scope as set out in the accompanying claims.

What i claim is:

1. A silver halide color photographic light-sensitive material having, on a transmissive support, at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloid layer, and containing a water-soluble dye that gives a maximum absorption in the range of 570 to 610 nm and a half width at half maximum on the longer wavelength side of 40 nm or less in a hydrophilic colloid layer, and a water-soluble dye that gives a maximum absorption at 740 nm or more and a half width at half maximum on the shorter wavelength side of 100 nm or less in a hydrophilic colloid layer.

2. The silver halide color photographic light-sensitive material as claimed in claim 1, wherein the water-soluble dye that gives a maximum absorption in the range of 570 to 610 nm is a dye selected from the group consisting of oxonol dyes, azo dyes, anthraquinone dyes, allylidene dyes, styryl dyes, triarylmethane dyes, merocyanine dyes, and cyanine dyes.

3. The silver halide color photographic light-sensitive material as claimed in claims 1, wherein the water-soluble dye that gives a maximum absorption in the range of 740 nm or more is a dye selected from the group consisting of dihydroperimidine squarilium dyes, cyanine dyes, pyrylium dyes, diimonium dyes, pyrazolopyridone dyes, indoaniline dyes, polymethine dyes, oxonol dyes, anthraquinone dyes, naphthalocyanine dyes, naphtholactam dyes, and metal chelate compounds.

4. The silver halide color photographic light-sensitive material as claimed in claim 1, further containing a water-soluble dye that gives a maximum absorption in the range of from 650 to less than 740 nm and a half width at half maximum on the shorter wavelength side of 80 nm or less in a hydrophilic colloid layer.

5. The silver halide color photographic light-sensitive material as claimed in claim 4, wherein the water-soluble dye that gives a maximum absorption in the range of from 650 to less than 740 nm is a dye selected from the group consisting of azo dyes, oxonol dyes, anthraquinone dyes, and metal complex dyes.

6. The silver halide color photographic light-sensitive material as claimed in claim 1, in which a relationship between a transmission absorption density at 590 nm (AS) and a transmission absorption density at 800 nm (AI) is expressed by an expression as described below:

$$\frac{AI}{AS} > 0.3.$$

7. The silver halide color photographic light-sensitive material as claimed in claim 1, wherein at least one cyan color-forming light-sensitive silver halide emulsion layer has a spectral sensitivity that has a maximum value in the range of 650 to 700 nm.

8. The silver halide color photographic light-sensitive material as claimed in claim 1, wherein at least one non-light-sensitive hydrophilic colloidal layer contains a solid fine-particle dispersion of a dye represented by the following formula (I):

$$D—(X)_y \qquad \text{Formula (I)}$$

wherein, in formula (I), D represents a group to give a compound having a chromophore, X represents a dissociable hydrogen or a group having a dissociable hydrogen, and y is an integer from 1 to 7.

9. The silver halide color photographic light-sensitive material as claimed in claim 8, wherein the dye represented by formula (I) is a dye represented by the following formula (II) or (III):

$$A^1{=}L^1{-}(L^2{=}L^3)_m{-}Q \qquad \text{Formula (II)}$$

wherein, in formula (II), $A^1$ represents an acidic nucleus, Q represents an aryl group or a heterocyclic group, $L^1$, $L^2$ and $L^3$ each independently represents a methine group, and m is 0, 1 or 2, and the compound represented by formula (II) possesses 1 to 7 carboxylic acid groups in its molecule;

$$A^1{=}L^1{-}(L^2{=}L^3)_n{-}A \qquad \text{Formula (III)}$$

wherein, in formula (III), $A^1$ and $A^2$ each independently represents an acidic nucleus, $L^1$, $L^2$ and $L^3$ each independently represents a methine group, and n is 1 or 2, and the compound represented by formula (III) possesses, in its molecule, 1 to 7 carboxylic acid groups as the group having a dissociable hydrogen.

10. The silver halide color photographic light-sensitive material as claimed in claim 9, wherein the dye represented by formula (III) is a compound represented by formula (IV):

formula (IV)

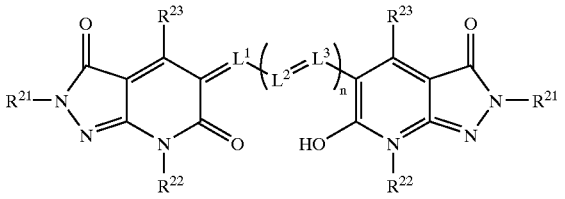

wherein, $R^{21}$ represents a hydrogen atom, an alkyl group, an aryl group, or a heterocyclic group; $R^{22}$ represents a hydrogen atom, an alkyl group, an aryl group, a heterocyclic group, —$COR^{24}$ or $SO_2R^{24}$ $R^{23}$ represents a hydrogen atom, a cyano group, a hydroxyl group, a carboxyl group, an alkyl group, an aryl group, —$CO_2R^{24}$, —$OR^{24}$, —$NR^{25}R^{26}$, —$CONR^{25}R^{26}$, —$NR^{25}COR^{24}$, —$NR^{25}SO_2R^{24}$ or —$NR^{25}CONR^{25}R^{26}$, wherein $R^{24}$ represents an alkyl group or an aryl group, and $R^{25}$ and $R^{26}$ each independently represents a hydrogen atom, an alkyl group, or an aryl group; $L^1$, $L^2$ and $L^3$ each independently represents a methine group, and n denotes 1 or 2.

11. The silver halide color photographic light-sensitive material as claimed in claim 8, wherein the solid fine-particle dispersion of a dye is prepared through a heat treating step carried out at 40° C. or higher.

12. The silver halide color photographic light-sensitive material as claimed in claim 8, wherein the dye in the solid fine-particle dispersion is applied in an amount of 0.05 to 0.5 $g/m^2$.

* * * * *